US006648633B1

(12) United States Patent
Suchan et al.

(10) Patent No.: US 6,648,633 B1
(45) Date of Patent: Nov. 18, 2003

(54) APPARATUS FOR CLEANING A COILER FURNACE DRUM

(75) Inventors: Michael J. Suchan, Regina (CA); Russell J. Brooks, Blue Grass, IA (US); Glen Banowetz, Charlotte, IA (US)

(73) Assignee: Ipsco Enterprises Inc., Lisle, IL (US)

( * ) Notice: Subject to any disclaimer, the term of this patent is extended or adjusted under 35 U.S.C. 154(b) by 0 days.

(21) Appl. No.: 10/261,027

(22) Filed: Sep. 30, 2002

(51) Int. Cl.[7] ..... F27D 23/02
(52) U.S. Cl. ..... 432/75; 432/2; 134/8
(58) Field of Search ..... 432/2, 75, 252, 432/260, 103; 15/246.5; 134/7, 8–9; 494/27, 37

(56) References Cited

U.S. PATENT DOCUMENTS 3,762,950 A * 10/1973 Royka ..... 134/6
4,708,194 A 11/1987 Mohn
4,793,400 A 12/1988 Wood
5,498,156 A 3/1996 Smith
5,603,167 A * 2/1997 Toyoda et al. ..... 34/104

* cited by examiner

*Primary Examiner*—Gregory Wilson
(74) *Attorney, Agent, or Firm*—Robert Barrigar

(57) ABSTRACT

A coiler drum cleaner for cleaning the drum of a coiler furnace (typically associated with a reversing rolling mill or Steckel mill) is disclosed. The coiler drum cleaner includes a cleaning element rotatably mounted at one end of a longitudinally extending tubular member, the tubular member being movably installed in association with a coiler furnace such that the cleaning element may be inserted into the coiler furnace and moved across the surface of the coiler drum, by moving the tubular member substantially parallel to the axis of rotation of the coiler furnace drum. The tubular member also includes means for moving the cleaning element roughly perpendicular to the longitudinal axis of the tubular member so as to bring the cleaning element into contact with the drum. In use, the cleaning element is inserted into the coiler furnace, brought into contact with the coiler drum and rotated so as to clean the coiler drum. Preferably, the cleaning element is a cylindrical brush having a plurality of resiliently-flexible carbide-tipped steel tines arrayed about its circumference. The tubular member may also include cooling means.

90 Claims, 17 Drawing Sheets

APPARATUS FOR CLEANING A COILER FURNACE DRUM

FIELD OF THE INVENTION

The invention relates to a drum cleaner for cleaning a coiler furnace drum such as a drum of the type found in coiler furnaces for use with Steckel mills (reversing rolling mills).

BACKGROUND TO THE INVENTION

A Steckel mill is one of the various types of rolling mill commonly installed in a production line for the manufacture of steel plate or strip. A Steckel mill is typically used to roll the steel (so as to reduce the thickness of the steel) while the steel is at a desired (typically relatively high) temperature so as to produce a desired steel microstructure. As such rolling reduction typically requires more than one pass (and sometimes several passes) through the Steckel mill, coiler furnaces are typically installed in line with the Steckel mill (one coiler furnace upstream of the Steckel mill and a second downstream of the Steckel mill) to maintain the temperature of the steel between passes through the Steckel mill. A coiler furnace has an internal rotatable generally-cylindrical drum. The leading edge (for the time being) of coilable plate or strip emerging from the Steckel mill that requires further passes through the Steckel mill is directed into the nearer coiler furnace and wound onto its drum. Subsequently, the plate or strip is unwound from the drum as it is fed back through the Steckel mill for a further pass. Sometimes, steel is temporarily kept coiled in the coiler furnace while other operations are in progress and then uncoiled and sent downstream on the production line or, if further rolling in the Steckel mill is required, after the next pass it is wound onto the drum of a coiler furnace on the other side of the Steckel mill.

During use, the work surface of the coiler furnace drum (that is, that portion of the coiler furnace drum that contacts the plate or strip) tends to accumulate unwanted matter such as scale and other debris. It is desirable to remove this unwanted matter from time to time to prevent it from being transferred to, and thus contaminating, the steel plate or strip wound on the drum.

To clean coiler furnace drums, it is conventional practice to hold a scraper (typically a piece of scrap steel) against the periphery of the drum, while the drum is rotated, so as to scrape unwanted matter from the surface of the drum. This procedure is sometimes ineffective and hazardous, and typically may be performed only when the coiler furnace is idle and (depending on the means for holding the scraper against the drum) relatively cool. Coiler furnace housings incorporating pivoting gates with scrapers attached at their distal ends, are also known. With such arrangements, the drum may be cleaned by pivoting the gate so as to bring the scraper into contact with the rotating drum.

Smith (U.S. Pat. No. 5,498,156, issued Mar. 12, 1996) discloses a dual-purpose guide and drum cleaner for coiler furnace winding drums. The guide and drum cleaner functions as a pivoting guide for guiding steel plate or strip into the coiler furnace so as to engage the winding drum and thus be coiled within the coiler furnace. The pivoting guide also functions as a drum cleaner in that it has a drum cleaner element attached at its distal end that can be brought into contact with the rotating drum to rub against the outer cylindrical surface of the drum so as to knock off the unwanted matter clinging to the drum's surface. Smith discloses two alternative drum cleaner elements, a consumable, abrasive-type cleaning element and a scraper-type cleaning element. When the abrasive or scraper-type cleaning element is worn down, it is replaced with a fresh cleaning element.

Due to uneven wear along their lengths, known drum cleaners typically do not provide even or consistent contact pressure against the drum, and thus do not provide even or consistent cleaning of the drum. Further, with cleaning elements that are attached to gates in the coiler furnace housing or that are part of a guide, the coiler furnace must be shut down and permitted to cool in order to replace worn cleaning elements. What is needed is a coiler drum cleaner that effectively cleans the surface of the coiler drum; that can be used when the coiler drum is at its normal operating temperature; and that permits maintenance and changing of the cleaning element while the coiler furnace is at its normal operating temperature. Such cleaner would be expected to facilitate consistent and uniform removal of debris along the length of the drum and would tend to minimize down time while cleaning is performed.

SUMMARY OF THE INVENTION

A coiler furnace drum has a peripheral cylindrical surface and is rotatable. In this specification and in the appended claims:

a) "work surface" refers to the portion of the peripheral cylindrical surface of the drum that is available for contact with the steel that is wound around the drum when the coiler furnace is in use;

b) "drum length" refers to the length of the work surface as measured parallel to the axis of rotation of the drum;

c) "drum circumference" refers to the circumference of the work surface;

d) "axial" and "axially" refer to a direction or movement substantially parallel to the axis of rotation of the drum; and e) "radial" and "radially" refer to a direction or movement that is substantially perpendicular to an axial direction.

In accordance with an aspect of the present invention, there is provided a coiler drum cleaner comprising means for moving a cleaning element toward and into close proximity with the work surface, and means for supporting the cleaning element and moving the cleaning element axially, such that during the cleaning operation, the cleaning element may be moved axially so as to bring the cleaning element into contact with different circumferential portions of the work surface. Axial movement of the cleaning element during the cleaning operation compensates for inconsistencies in the cleaning effectiveness of different portions of the cleaning element (due, perhaps, to wear).

The axial length of the cleaning element that in use is engageable with unwanted matter on the work surface for removing the unwanted matter, is preferably less than the drum length (and more preferably no more than about half of the drum length), such that during use, the cleaning element is moved across the work surface of the rotating drum in order to contact and remove unwanted matter from the whole of the work surface. A cleaning element with a length considerably less than the drum length will typically be less costly than a cleaning element with a length equal to or greater than the drum length. As well, a cleaning element with a length considerably less than the drum length will enable more efficient cleaning in that the cleaning action can be localized so as to provide cleaning action for a longer or shorter time period as needed for different portions of the work surface.

The coiler drum cleaner includes means for retractably inserting the cleaning element into the coiler furnace, such that between cleaning operations, the cleaning element may be completely withdrawn from the coiler furnace, so that: the cleaning element does not interfere with the operation of the coiler furnace; the cleaning element is exposed to the high temperatures of the interior of the coiler furnace only for the time required to perform the cleaning operation; and maintenance of the coiler drum cleaner, such as changing or inspecting the cleaning element, may occur while the coiler furnace is operational.

In accordance with an aspect of the present invention, there is provided means for axially retractably inserting the cleaning element into the coiler furnace. In accordance with another aspect of the present invention, the coiler drum cleaner is configured such that the axial movement of the cleaning element for insertion into, and retraction from, the coiler furnace of the cleaning element, is in the same direction of movement as the movement of the cleaning element along the work surface over the drum length during cleaning. In this way, the means for inserting and retracting the cleaning element, and the means for moving the cleaning element axially along the work surface over the drum length, may be one and the same, or may make use of some of the same components.

Preferably, the means for axially retractably inserting the cleaning element and the means for axially moving the cleaning element along the work surface over the drum length, comprise a cleaner frame, in use installed adjacent to the coiler furnace; and a longitudinally-extending cleaning element support member having an insertion end for insertion into the coiler furnace and supporting the cleaning element proximate to the insertion end, the cleaning element support member supported by the cleaner frame and axially displaceable relative to the cleaner frame, wherein, the insertion end of the cleaning element support member and the cleaning element are axially retractably insertable into the coiler furnace by axial displacement of the cleaning element support member relative to the cleaner frame.

Preferably, the cleaning element support member is a rectangular, tubular member, supported by two sets of rollers rotatably mounted on the cleaner frame, such that the cleaning element support member is cantilevered when the insertion end of the cleaning element support member is inserted into the coiler furnace. However, it will be clear that the cleaning element support member need not be rectangular in cross-section and need not be tubular.

Preferably, the cleaning element support member is moved longitudinally with a rack-and-pinion assembly driven by an electric motor, with the rack attached to the cleaning element support member and the electric motor attached to the pinion and mounted on the cleaner frame. It will be clear that other conventional means could be used for moving the cleaning element support member, such as a hydraulic or pneumatic ram, or a worm gear.

Preferably, the means for biasing the cleaning element toward and into close proximity with the work surface comprises means for radially displacing the cleaning element relative to the cleaning element support member towards the work surface. Alternatively, the means for biasing the cleaning element toward and into close proximity with the work surface could comprise means for moving the insertion end of the cleaning element support member radially towards the work surface. Such means could comprise: means for radially displacing the cleaning element support member relative to the cleaner frame; means for pivoting the cleaning element support member relative to the cleaner frame so as to swing the insertion end of the cleaning element support member towards the work surface; means for radially moving the cleaner frame so as to move both the cleaner frame and the cleaning element support member radially together; and means for pivoting the cleaner frame and the cleaning element support member together.

Preferably, the means for radially displacing the cleaning element relative to the cleaning element support member comprises a carriage, to which the cleaning element is mounted, the carriage being slidably mounted to the cleaning element support member such that the carriage may be reversibly radially displaced relative to the cleaning element support member towards the work surface; and means for radially displacing the carriage relative to the cleaning element support member toward the work surface. Preferably, the means for radially displacing the carriage comprises a reversibly expandible device, such as a pneumatic bag or hydraulic or pneumatic ram, interposed between the carriage and the cleaning element support member, and means for providing pressurized fluid to the expandible device. The means for radially displacing the carriage may be another expandible device, or other conventional means for effecting such relative displacement, such as a rack and pinion, or worm gear.

When the coiler drum cleaner is configured and installed so that the cleaning element is below the drum when inserted into the coiler furnace, then the radial displacement of the carriage towards the work surface will be upwards and gravity may be utilized to move the carriage away from the work surface after the cleaning operation.

Alternatively, for installations where the cleaning element is not below the drum when in use, or additionally, for installations where the cleaning element is below the drum when in use but gravity is not adequate to move the carriage away from the work surface, there may be provided means for causing the carriage to move away from the work surface. Such means may comprise a hydraulic or pneumatic ram attached to both the carriage and the cleaning element support member, so as to be both a means for radially displacing the carriage toward the work surface and a means for moving the carriage away from the work surface. When the means for radially displacing the carriage comprises a pneumatic bag interposed between the carriage and the cleaning element support member, the means for causing the carriage to move away from the work surface may comprise a rocker arm, pivotally mounted to the cleaning element support member. The rocker arm has a linked first end pivotally engaging the carriage and a free second end. A reversibly expandible pneumatic bag is interposed between the second end and the cleaning element support member, wherein, expanding the pneumatic bag causes the rocker arm to pivot so as to move the carriage and cleaning element away from the work surface.

There may also be provided means for adjusting the force with which the cleaning element is held against the drum so as to alter the aggressiveness of the cleaning action of the cleaning element. Such means may comprise a pressure regulating valve for regulating the pressure of the pressurized fluid provided to a pneumatic bag, pneumatic ram or hydraulic ram interposed between the carriage and the cleaning element support member.

It is conceivable that the cleaning element support member be movable for insertion into, and retraction from, the coiler furnace in a direction substantially perpendicular to the axis of rotation of the drum, such that the means for inserting and retracting the cleaning element support member, and the means for biasing the cleaning element against the rotating drum, are one and the same. For example, the cleaning element support member could be configured and positioned for insertion into the coiler furnace through the top of the coiler furnace. However, with such a configuration, the insertion/removal apparatus would have to be installed so as to take up space in the production line (where space is typically limited) rather than installed to the side of the production line.

In accordance with another aspect of the present invention, the cleaning element is configured to be rotated during use; is rotatably mounted to the carriage; and is rotated during the cleaning operation. Preferably, the rotatable cleaning element is a substantially cylindrical brush comprising an array of projecting, resiliently-flexible tines. Preferably, the tines are steel and are carbide-tipped. Preferably, the axis of rotation of the brush is substantially parallel to the axis of rotation of the drum.

Alternatively, the rotatable cleaning element may have an abrasive cylindrical periphery, perhaps made by removably attaching suitable replaceable abrasive material to a reusable core.

In use, it is desirable to position the brush at a selected cleaning position (that is, at a selected radial proximity to the work surface) such that the contact between the tines and the work surface is suitable for effective cleaning of the work surface, but does not subject the tines to undue wear or damage during the cleaning operation. Preferably, the coiler drum cleaner includes a depth guide configured and positioned to contact the drum when the brush is in the selected cleaning position and, when contacting the drum, to impede movement of the cleaning element towards the drum so as to protect the tines. Preferably, the depth guide is mounted to the carriage adjacent to the brush, such that the depth guide moves along the work surface over the drum length with the brush during the cleaning operation. The depth guide may, in use, tend to contact the unwanted matter to be removed from the work surface. Conceivably, as the depth guide rides over such unwanted matter, the depth guide could cause the carriage to move away from the work surface so as to reduce the cleaning effectiveness of the brush. However, in practice, this is not a problem. Generally the thickness of unwanted matter permitted to build up on the work surface is not appreciable, and the slight variations in the contact between the tines and the work surface caused by the depth guide riding over this unwanted matter does not affect the cleaning effectiveness. From time to time the unwanted matter builds to a sufficient thickness that it does reduce the cleaning effectiveness. However, this can be easily dealt with by making more than one pass of the brush over the work surface or over the portion of the work surface with the unusually-thick unwanted matter.

The depth guide may be a wheel, mounted concentric with the axis of rotation of the cleaning element and free to rotate. In this way, when the depth guide is contacting the rotating drum, friction between the depth guide and the drum will cause the depth guide to rotate rather than merely rub against the drum, so as to reduce wear on the portion of the depth guide for the time being in contact with the drum. Two depth guides may be provided, one depth guide located at one end of the rotatable cleaning element and the other depth guide located at the other end of the cleaning element.

The cleaning element may be rotated by an electric motor, also mounted on the cleaning element support member and drivingly coupled to the cleaning element with a drive shaft. Other conventional means for providing rotational drive to the cleaning element may also be used. Preferably, the cleaning element is housed proximate to one end of the cleaning element support member (the cleaning end) and the electric motor (or other means for rotating the cleaning element) is mounted proximate to the other end of the cleaning element support member, such that the electric motor is not inserted into the coiler furnace during the cleaning operation and thus is not exposed to the high temperatures within the coiler furnace. Preferably, the axis of rotation of the cleaning element is substantially parallel to the longitudinal axis of the cleaning element support member, as this configuration permits a relatively simple mechanical coupling, such as a shaft and possibly gears between the cleaning element and the motor driving the cleaning element. However, it will be clear that the axis of rotation of the cleaning element need not be substantially parallel to the longitudinal axis of the cleaning element support member; for example, bevel gears could be used to accommodate an axis of rotation of the cleaning element that is not parallel to the longitudinal axis of the cleaning element support member.

Alternatively, the coiler drum cleaner may comprise two (or possibly more) rotatable cleaning elements, each rotatably mounted in a respective carriage Preferably, the rotatable cleaning elements have similar diameters and are aligned so as share a common axis of rotation; and the carriages are axially spaced. Preferably, each of the carriages is slidably mounted to the cleaning element support member as described above for a single carriage. Alternatively, the two or more rotatable cleaning elements may be rotatably mounted in a single carriage.

Typically, such dual (or multiple) cleaning elements will be designed to provide equally aggressive cleaning from each. For example, where the cleaning elements are brushes, the tines on one brush will be essentially identical to the tines on the other brush. The use of such dual cleaning elements can reduce the time required to clean the drum, in that two cleaning elements will clean more quickly than a single similarly-sized cleaning element. Preferably, both of the dual cleaning elements rotate on one shaft, or the shafts that they rotate on are connected end to end, such that a single means for rotating the cleaning elements, such as an electric motor, may be used to rotate both cleaning elements at the same time and at the same speed.

Alternatively, the cleaning aggressiveness of the dual cleaning elements may be different, one from the other, and the dual cleaning elements may be used sequentially when cleaning the drum, such as for example, where both the cleaning elements are brushes, the tines of one brush may be sharper, harder and/or stiffer for a first aggressive cleaning of the drum surface (such as to remove large particles firmly attached to the drum surface) and the tines of the other brush may be less stiff for less aggressive cleaning (such as to remove smaller particles perhaps missed by the first brush or to polish the drum surface). Such dual cleaning elements having different cleaning aggressiveness may be structured and operated to be rotated at the same speed or at different speeds.

The rotatable cleaning elements or coiler drum cleaners comprising two or more cleaning elements, need not be similar in diameter and need not share the same axis of rotation.

Preferably, there is also provided means for cooling the cleaning element support a trough-like cavity within the cleaning element support member suitable for containing cooling liquid so as to partially submerge the brush. Such cooling means may include a cooling header for showering the cleaning element and adjoining components with water (or other liquid suitable for cooling). Such cooling means may also include channels within the carriage to permit the circulation of water or other liquid suitable for cooling within the carriage. Preferably, such channels in the carriage are connected to ports opening at or adjacent to those surfaces of the carriage that slide against the cleaning element support member, such that these sliding surfaces may be cooled, and possibly partially lubricated, by the water or other liquid. Preferably, there is also provided means for cooling the portions of the cleaning element support member that are, during use, exposed to the high temperatures within the coiler furnace. Such cleaning element support member cooling means may comprise channels in the cleaning element support member for circulating water, other liquid suitable for cooling or air, to be circulated throughout the length of the cleaning element support member. Such channels may be provided by using hollow tubes as longitudinal structural components in the cleaning element support member, as the interiors of such tubes provide ready-made channels. Such cooling header, carriage channels and cleaning element support member cooling means may be in fluid communication, with one another, such that, for example, water may be circulated through channels in the cleaning element support member and thence to the carriage channels and cooling header.

The various features of novelty that characterize the invention are pointed out with more particularity in the claims. For a better understanding of the invention, its operating advantages and specific objects attained by its use, reference should be made to the accompanying drawings and descriptive matter in which there are illustrated and described preferred embodiments of the invention.

DETAILED DESCRIPTION WITH REFERENCE TO THE DRAWINGS

Figure 1:
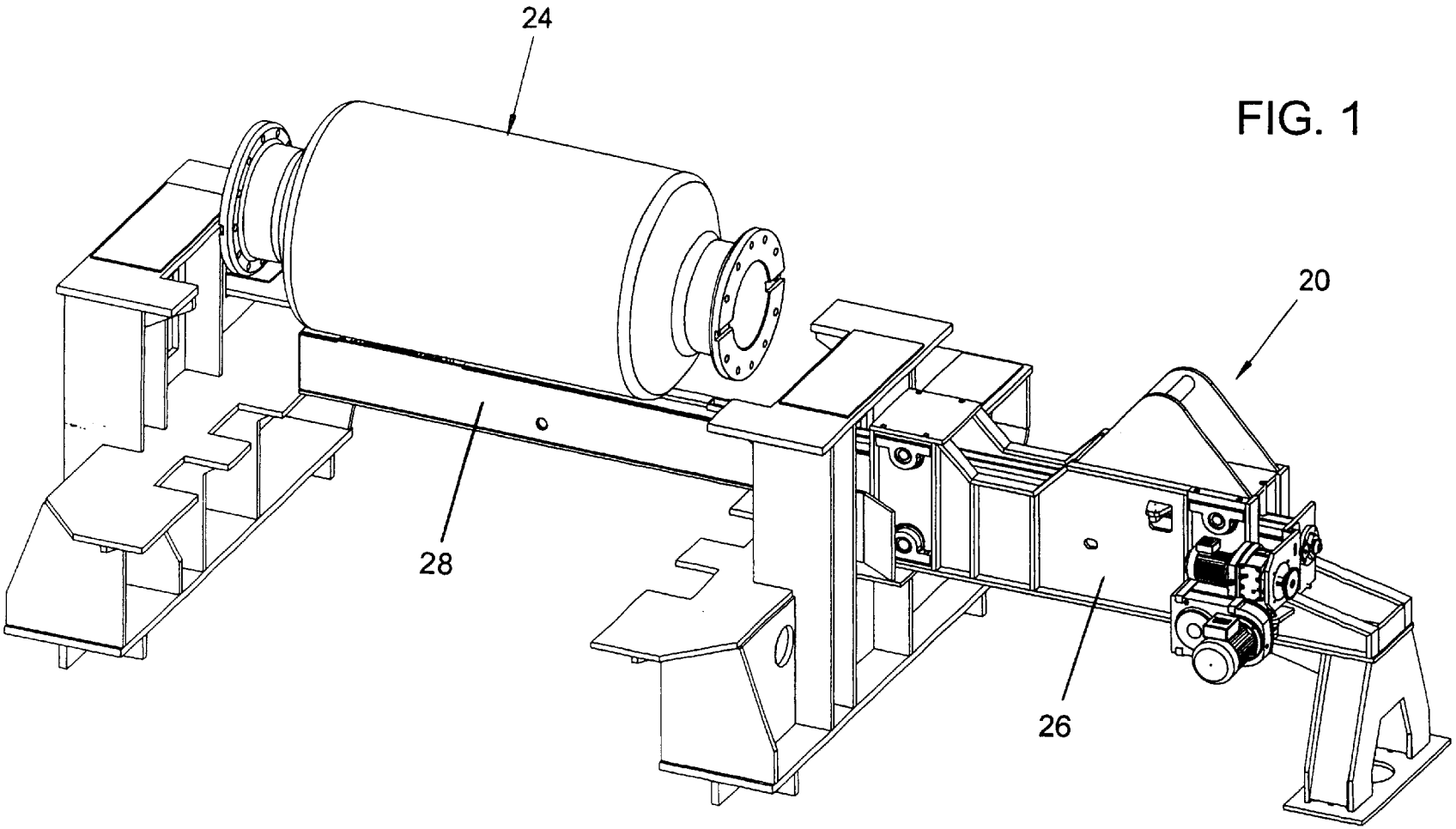
FIG. 1 is a front partially-cut-away isometric view of an exemplary single-brush cleaner embodiment of the present invention shown installed in association with a coiler furnace.

In this specification and in the claims, absolute directions such as up and down, and relative descriptive terms associated with absolute directions, such as top, bottom and side, are used for clarity of description and should not be understood as implying that the described embodiments cannot be used in a variety of orientations and relative positions.

Three different embodiments of the coiler drum cleaner of the present invention are described herein. In this description and in the relevant drawings, common components as between the different embodiments of the present invention are identified using common terms and common reference characters.

FIG. 1 shows an exemplary single-brush cleaner 20 in association with a coiler drum 24. For clarity, the housing of the coiler furnace (indicated in subsequent drawings with reference number 22) and the drive and support means for the coiler drum 24 are not shown in FIG. 1. The single-brush cleaner 20 includes a cleaner frame 26 and a brush tube 28 slidably mounted to the cleaner frame 26.

Figure 2:
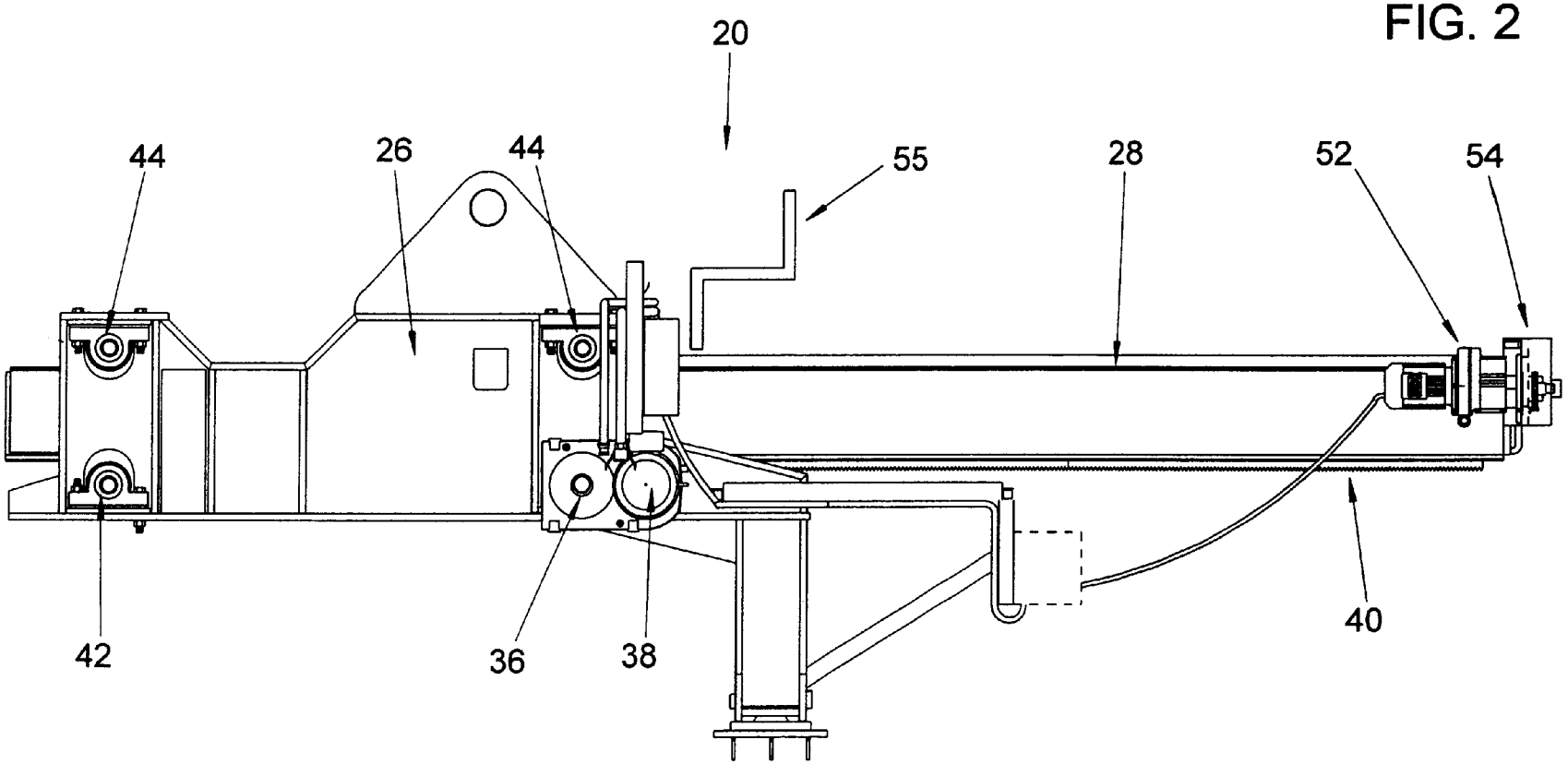
FIG. 2 is a front elevation view of the embodiment shown in FIG. 1.
Figure 3:
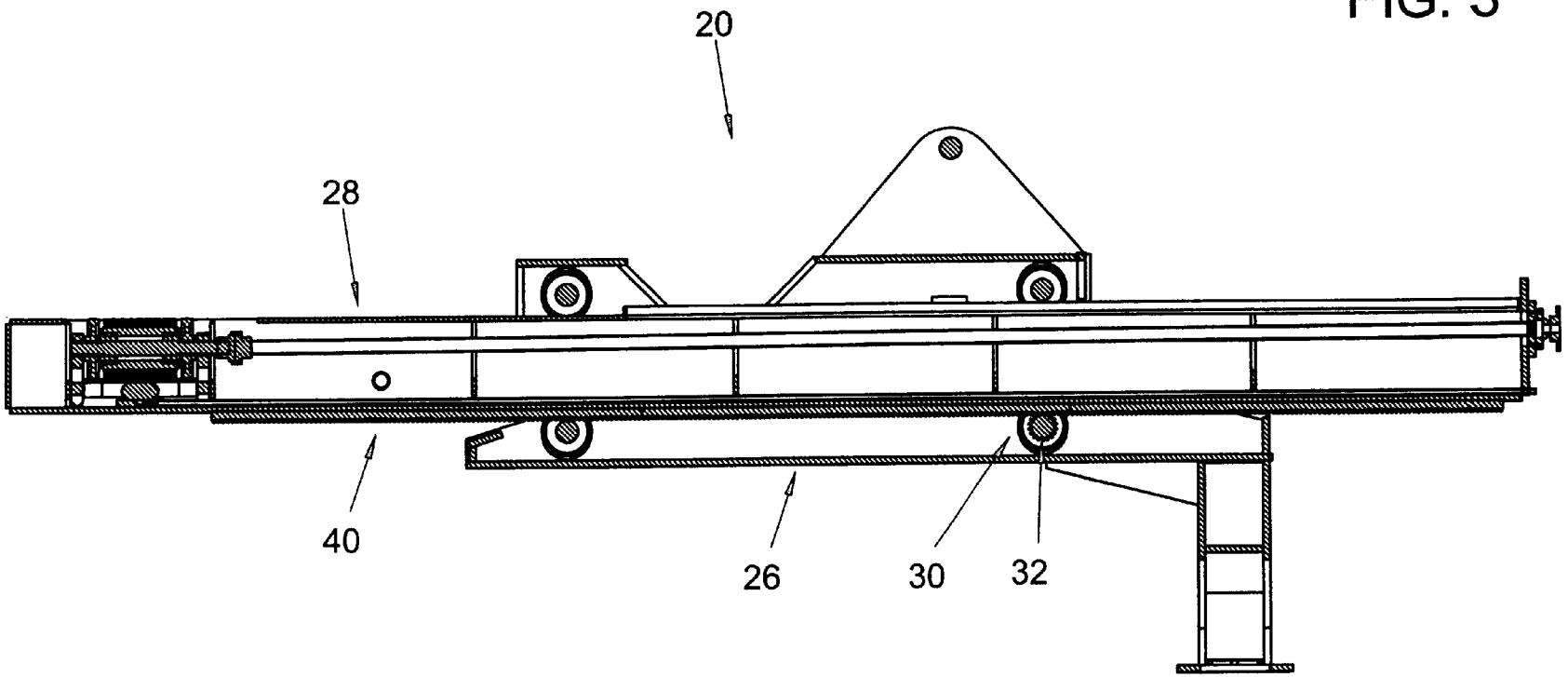
FIG. 3 is a front elevation section view of the embodiment shown in FIG. 1.

As shown in FIGS. 2 and 3, a pinion assembly 30 is rotatably mounted on the cleaner frame 26. The pinion assembly 30 includes a pinion gear 32 mounted on a pinion shaft (not visible in FIGS. 2 and 3). The pinion shaft is connected to the pinion gearbox 36 which is connected to the pinion motor 38. As shown in FIG. 3, the pinion gear 32 engages a rack 40 attached to the brush tube 28 for moving the brush tube 28 within the cleaner frame 26.

A base roller 42 is also rotatably mounted on the cleaner frame 26. The base roller 42 is spaced apart from, and aligned with, the pinion assembly 30 and has a profile similar to the pinion assembly 30, in that the base roller 42 has a central "cut-away" portion to provide clearance for the rack 40. Two top rollers 44 are rotatably mounted on the cleaner frame 26, one top roller 44 being mounted above the pinion assembly 30 and the other top roller 44 being mounted above the base roller 42. Each top roller 44 is spaced apart from the respective pinion assembly 30 or base roller 42 so as to provide cantilever support for the brush tube 28 such that the brush tube 28 may be moved so as to extend from the cleaner frame 26.

Figure 4:
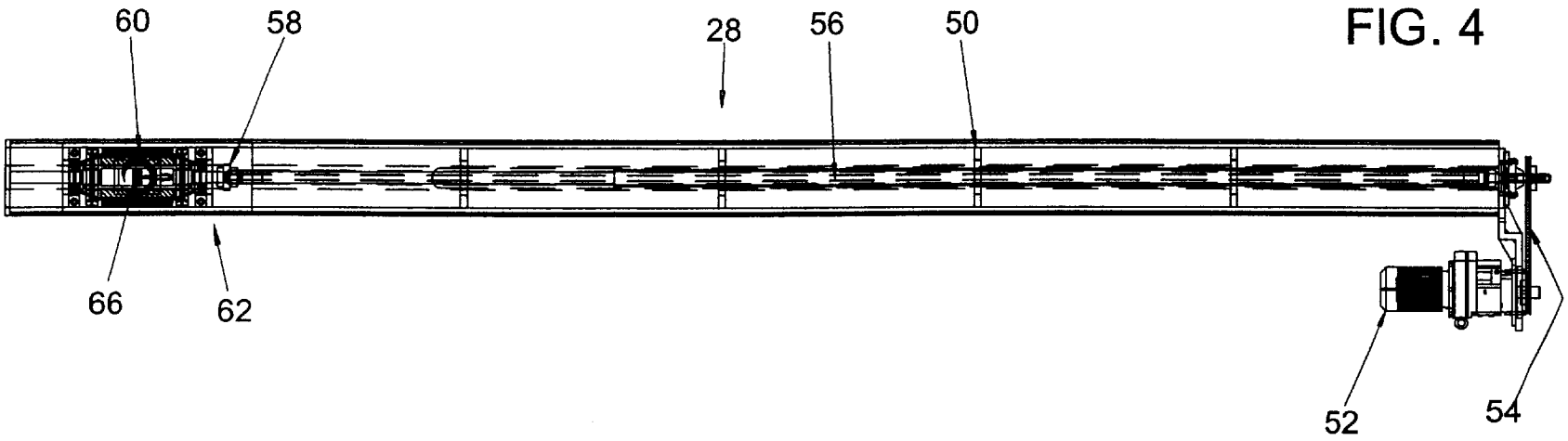
FIG. 4 is a top view of the brush tube of the embodiment shown in FIG. 1.
Figure 5:
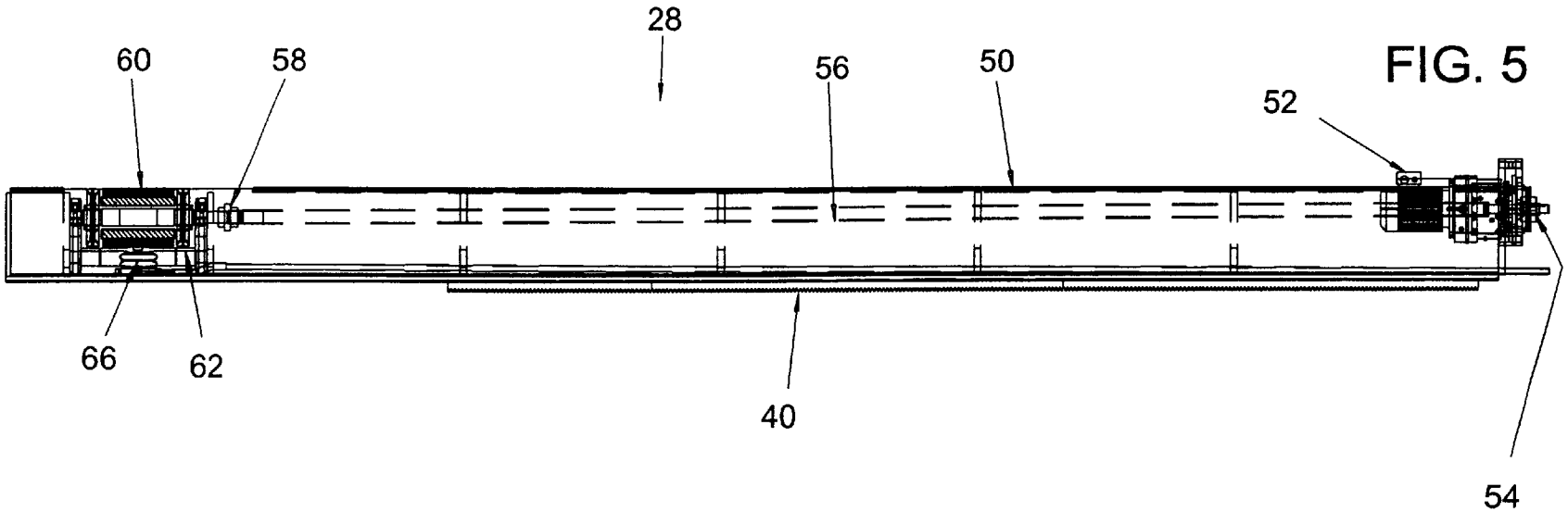
FIG. 5 is a front elevation view of the brush tube of the embodiment of FIG. 1.
Figure 6:
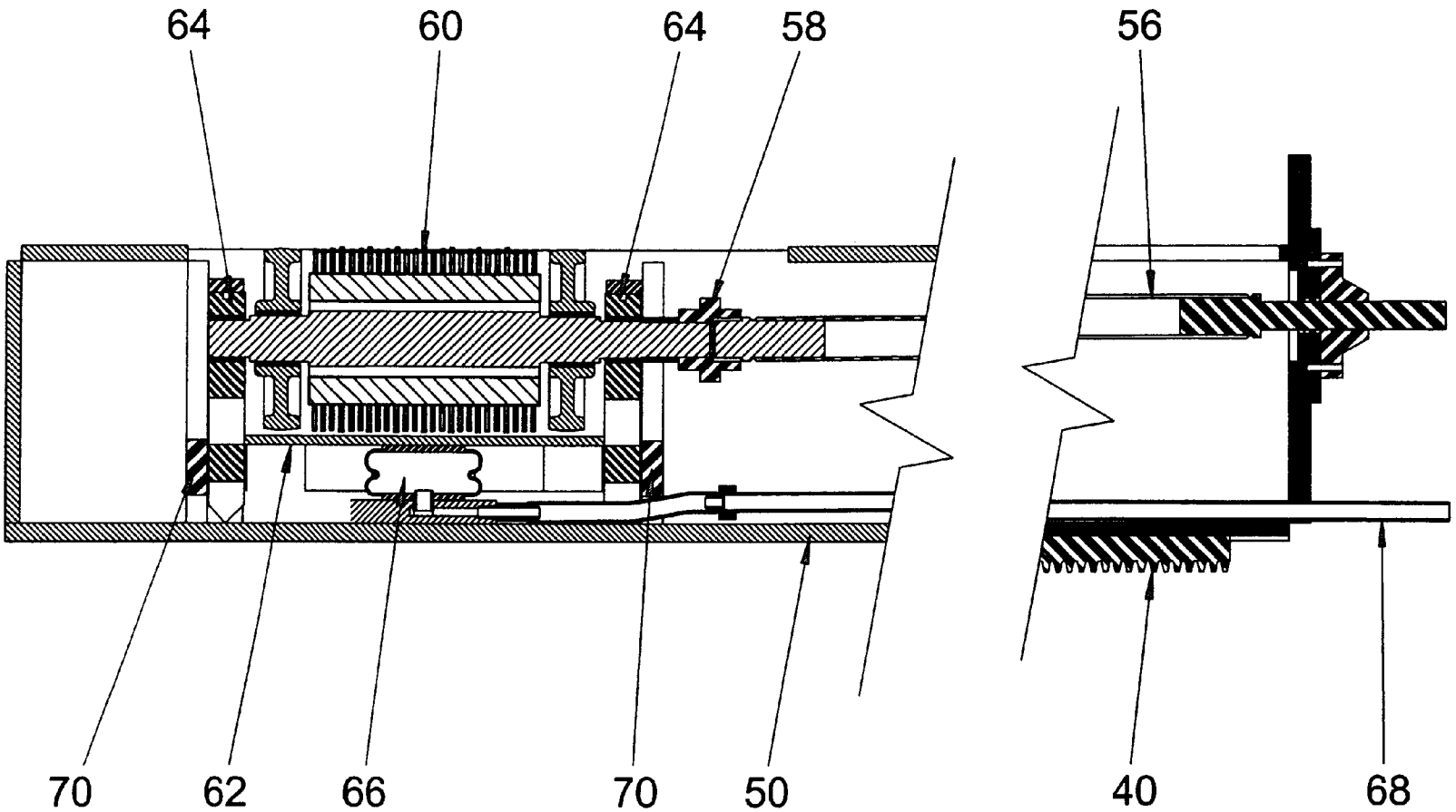
FIG. 6 is an enlarged-scale front elevation broken section view of the brush tube of the embodiment shown in FIG. 1.

As shown in plan view in FIG. 4, side elevation view in FIG. 5 and broken sectional view in FIG. 6, the brush tube 28 includes the brush tube body 50, brush motor 52, chain and sprocket assembly 54, brush drive shaft 56, flexible coupling 58, brush assembly 60, brush carriage 62, brush brackets 64, air bag 66 and pneumatic line 68.

The brush motor 52 is mounted on one end of the brush tube body 50 and is connected to the chain and sprocket assembly 54. The chain and sprocket assembly 54 is also connected to the one end of the brush drive shaft 56. The other end of the brush drive shaft 56 is connected to the brush assembly 60 via the flexible coupling 58. The brush assembly 60 is rotatably mounted in the brush carriage 62 and is held in position in the brush carriage 62 with the brush brackets 64. In use, rotation of the brush drive shaft 56 causes the brush assembly 60 to rotate The brush carriage 62 is slidably mounted in the brush tube body 50 within the carriage guides 70. The air bag 66 is connected to the pneumatic line 68. The air bag 66 is interposed between the brush carriage 62 and the adjacent interior wall of the brush tube body 50. In use, supplying compressed air to the air bag 66 via the pneumatic line 68 causes the air bag 66 to inflate and expand so as to push against the brush tube body 50 and the brush carriage 62 so as to cause the brush assembly 60 to move in the direction of increasing projection from the brush tube body 50. Withdrawing compressed air from the air bag 66 so as to permit the air bag 66 to deflate permits the brush assembly 60 to move (under the effect of gravity when installed in the bottom-mount position shown in FIG. 1) in the direction of decreasing projection from the brush tube body 50. The air bag 66 is a conventional such air bag, selected on the basis of space constraints, the pressure of the available compressed air and the desired cleaning force. Although it is preferable that the air bag 66 be reasonably resistant to deterioration or damage by high temperatures, so long as the brush tube 28 is cooled (discussed below), the air bag 66 is not exposed to the high operational temperatures of the coiler furnace 22. An example of a suitable air bag 66 is the Cutter Air Bag, Firestone Air Actuator Style Bag, Style 25, P/N WO1-358-7047. Other commercially-available air bags could be used.

Figure 7:
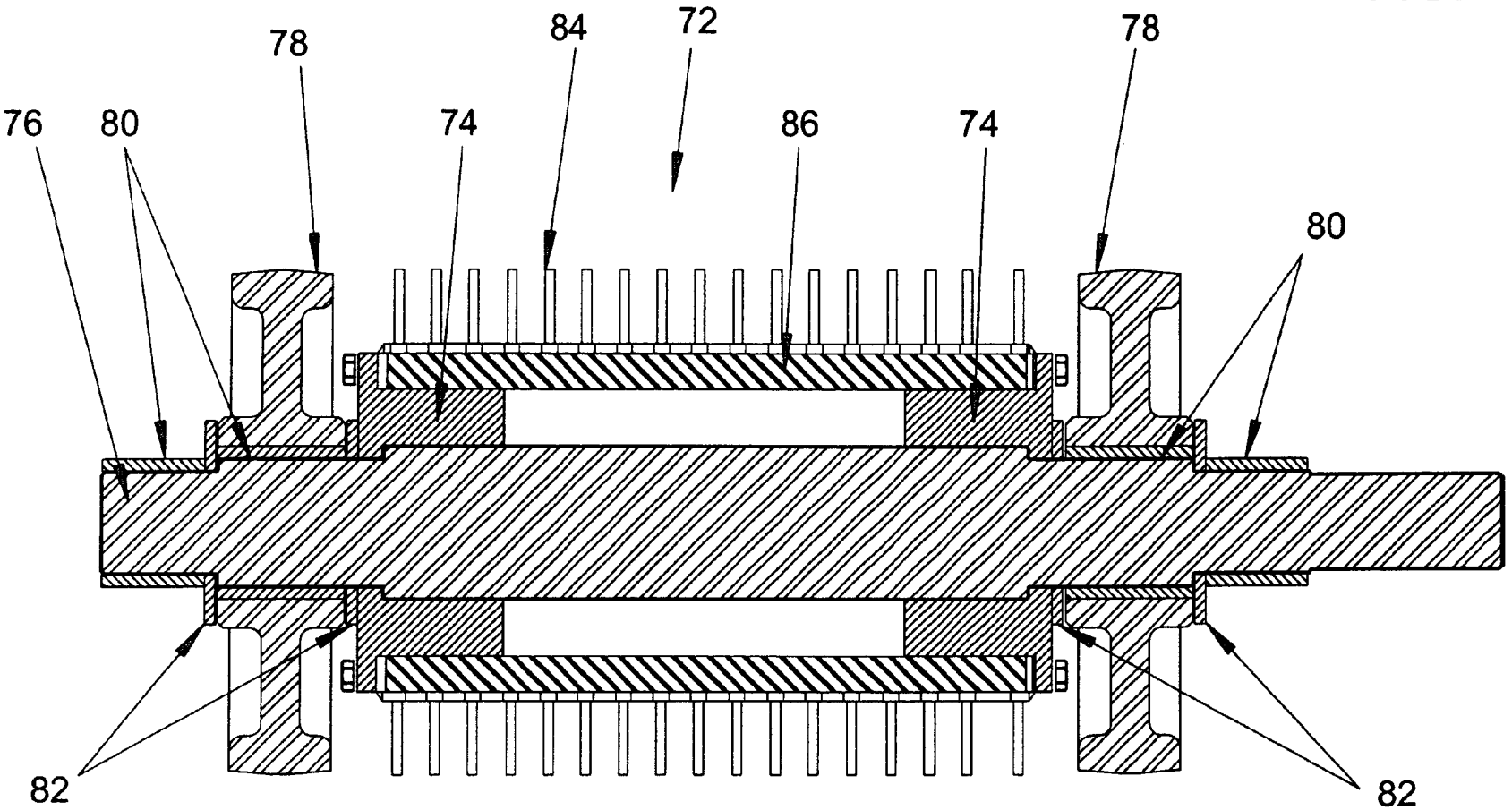
FIG. 7 is an enlarged-scale sectional view of the brush assembly shown in FIG. 6.

As shown in FIG. 7, the brush assembly 60 comprises a brush 72 mounted on two hubs 74, the hubs 74 being mounted on a brush shaft 76, the hubs 74 and brush shaft 76 being keyed to prevent relative rotation as between them. Two guide wheels 78 are rotatably mounted on the brush shaft 76. One guide wheel 78 is adjacent one end of the brush 72 and the other guide wheel 78 is adjacent the other end of the brush 72. Bushings 80 and thrust washers 82 permit the guide wheels 78 to rotate relative to the brush 72 and the brush shaft 76. The bushings 80 and thrust washers 82 are conventional bushings and thrust washers. Examples of appropriate materials for the bushings 80 and thrust washers 82 are WEARCOMP™; DEVLON™ "S" Grade Blue; and DEVLON™ "V" Grade API Yellow. The bushings 80 and thrust washers 82 may be made from other materials.

Figure 8:
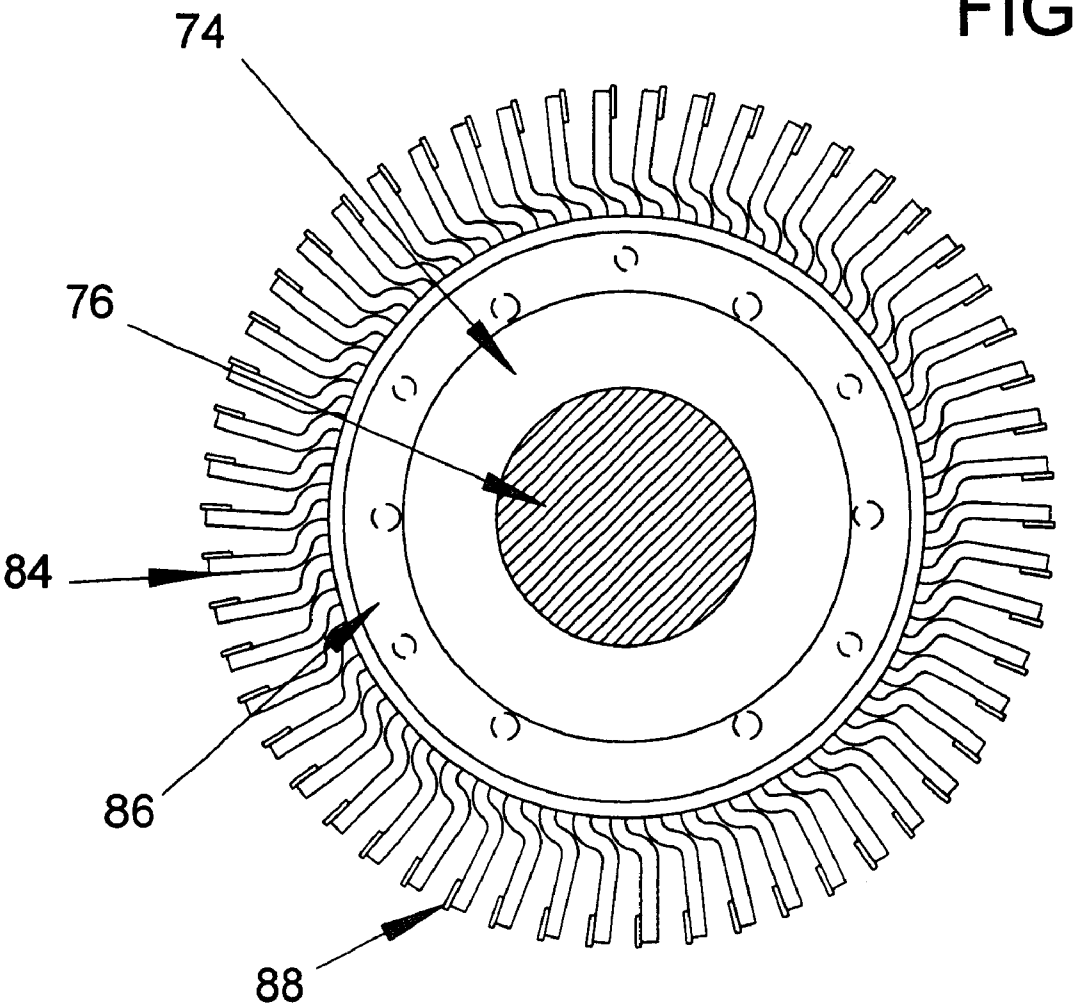
FIG. 8 is an enlarged-scale sectional view of a brush of the embodiment shown in FIG. 1.

As shown in FIGS. 7 and 8, the brush 72 comprises a plurality of projecting tines 84 arrayed about the circumference of the brush cylinder 86. Each tine 84 has a carbide tip 88. As shown in FIG. 8, a portion of each tine 84 is S-curved such that the S-curved portions of the adjacent tines 84 are closer together than both the proximal ends and distal ends of the tines 84, such that in use, when the brush 72 is rotating and the tines 84 are contacting the coiler drum 24 one after the other, each tine 84 may be partially supported by the S-curved portion of the tine 84 bearing against the S-curved portion of an adjoining tine 84. An example of a suitable brush 72 is the COMAX™ cylindrical brush, available from Industrial Robotics.

Alternatives to the brush 72 may also be possible, including: brushes with tines different from those described above and shown in the drawings; and rotatable elements having abrading surfaces rather than projecting tines. However, brushes with carbide-tipped tines as described herein, have been found to be suitable in use.

As shown in FIG. 1, the single-brush cleaner 20 is installed with the longitudinal axis of the brush tube 28 substantially parallel to the axis of rotation of the coiler drum 24.

The coiler furnace 22 has an opening (not shown) through which the brush tube 28 may be inserted axially into the coiler furnace 22. Typically the opening in the coiler furnace 22 is fitted with a cover or gate (not shown) to prevent heat loss through the opening in the coiler furnace 22 during normal operation of the coiler furnace 22. When not being used to clean the coiler drum 24, the brush tube 28 is completely withdrawn from the coiler furnace 22.

In use, the interior of the brush tube 28 defines a trough-like cavity that is filled with water such that a portion of the brush 72 is submerged, so as to cool the brush 72 and other components of the brush tube 28 when the brush tube 28 is inserted into the coiler furnace 22. It is preferable that minimal water be splashed into the coiler furnace 22 and onto the coiler drum 24. It has been found that if the brush 72 is rotated at no more than 60 RPM, no water, or minimal water, is thrown by the brush 72 onto the coiler drum 24. Preferably, a water supply pipe 55 (shown stylized in FIG. 2) is installed adjacent the single-brush cleaner 20 for convenient topping up of the water in the brush tube 28. Normally, the water is left in the brush tube 28 between cleaning operations, but the water may be drained from the brush tube 28 by way of an opening (not shown) in the bottom of the brush tube 28 that is normally closed, but may be opened to drain the water in order to, for example, perform maintenance on the components of the brush tube 28, or remove any detritus that might collect in the brush tube 28 during the cleaning operation.

For cleaning the coiler drum 24, the brush tube 28 is caused to move relative to the cleaner frame 26, by way of the pinion motor 38, pinion gear 32 and rack 40, so as to be inserted axially into the coiler furnace 22 via the opening in the coiler furnace 22. The brush tube 28 is aligned with the coiler drum 24 such that when the brush tube 28 is inserted into the coiler furnace 22, the tines 84 and guide wheels 78 can be moved from a rest position, in which they do not contact the work surface of the coiler drum 24, into contact with the work surface of the coiler drum 24, by providing compressed air to the air bag 66 via the pneumatic line 68. The guide wheels 78 act to locate the brush 72 at a desired cleaning position relative to the surface of the coiler drum 24 and also protect the tines 84 from harm caused by being forced too aggressively against the surface of the coiler drum 24.

Figure 9:
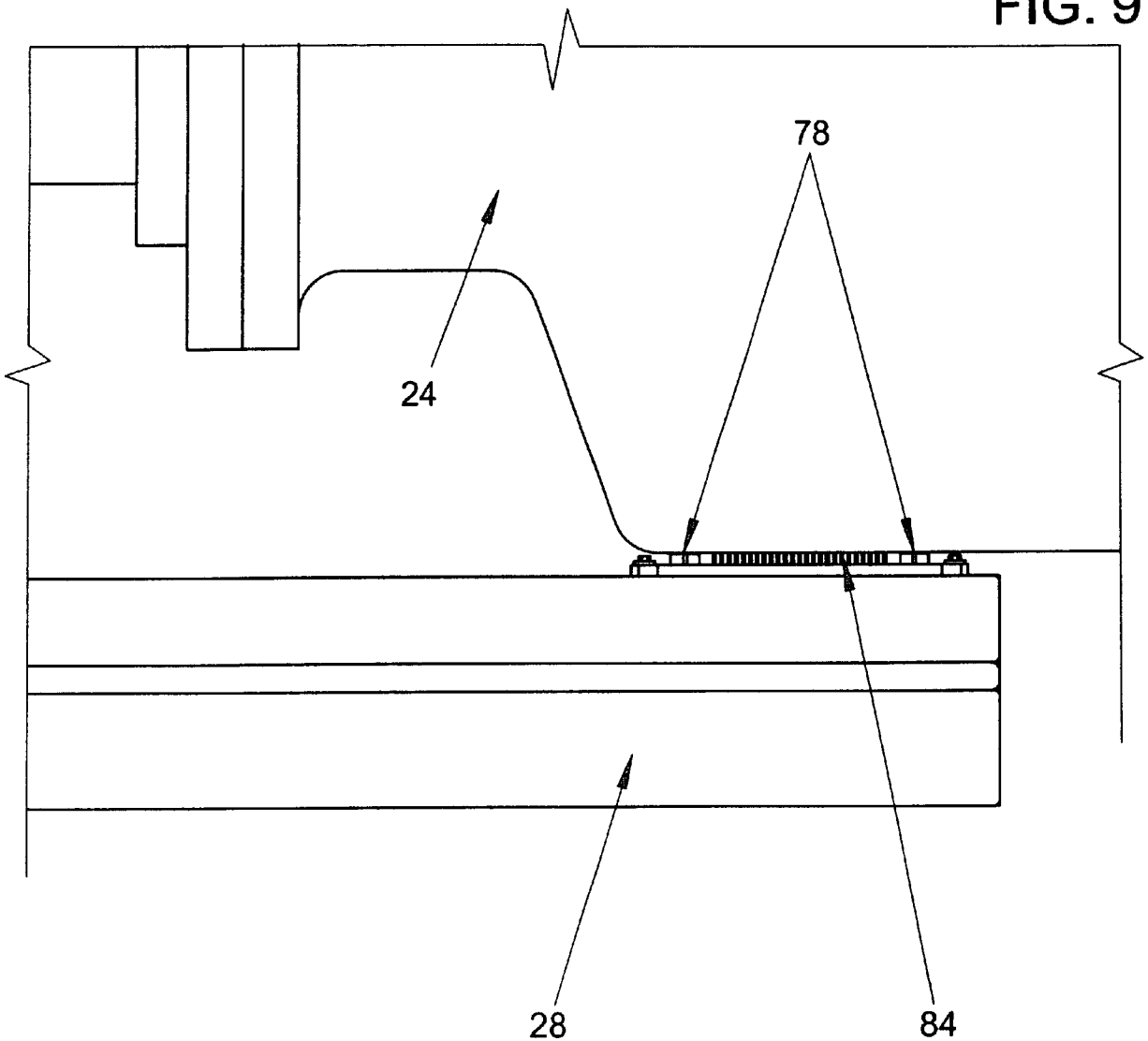
FIG. 9 is a side elevation schematic view of a portion of the brush tube of the embodiment shown in FIG. 1, showing the brush and guide wheels contacting a coiler drum.

During cleaning, the brush motor 52 is used to rotate the brush 72 so as to clean the surface of the coiler drum 24. Typically during the cleaning operation, the brush tube 28 is moved axially and the coiler drum 24 is rotated so as to bring the entire work surface of the coiler drum 24 into contact with the brush 72, that is, the brush tube 28 is moved axially between a partially-inserted start position (shown in FIG. 9) and a fully-inserted end position (shown in FIG. 1). This may be done in many ways, such as by sequentially holding the brush tube 28 in a series of positions within the coiler furnace 22 and rotating the coiler drum 24 at least once at each position of the brush tube 28 so as to clean a series of circumferential swaths. Alternatively, the brush tube 28 may be caused to move axially at a steady rate appropriate to the rate of rotation of the coiler drum 24 so as to clean a spiral path around the coiler drum 24.

During cleaning, it is preferable that the coiler drum 24 and the brush 72 be rotated in the same direction, that is, either both clockwise or both counterclockwise when viewed along their axes of rotation, so that the adjacent portions of the coiler drum 24 and brush 72 move in opposite tangential directions relative to each other.

Preferably, a video camera and monitor (not shown) are installed in association with the single-brush drum cleaner 20 to enable the person operating the single-brush drum cleaner 20 to observe the cleaning operation. Although it is possible to adjust the force with which the brush 72 is biased against the coiler drum 24, by changing the pressure of the compressed air provided to the air bag 66, such as by installing a pressure regulating valve (not shown), it has been found that cleaning effectiveness is more a function of the condition of the tines 84 and guide wheels 78, than of the biasing force. Therefore, in use, an effective pressure (i.e. one that balances cleaning effectiveness with preservation of the tines 84 and guide wheels 78) is determined empirically, and the available compressed air is regulated to this pressure or the air bag 66 is selected to be of a size to provide an appropriate cleaning force based on the normal pressure of the available compressed air. The operator of the single-brush drum cleaner 20 deals with those portions of the coiler drum 24 that are more difficult to clean, by positioning the rotating brush 72 against those harder-to-clean portions for a longer period of time than for easier-to-clean portions. In this way, the operator can provide localized cleaning action to the work surface of the coiler drum 24, as required.

The brush 72 and guide wheels 78 should be regularly inspected for wear, to ensure that the tines 84 are in good condition and that the guide wheels 78 properly position the brush 72 relative to the coiler drum during use, such that the brush 72 is sufficiently close for effective cleaning, but not so close that the tines 84 are excessively worn (or broken off) during the cleaning operation.

Once the coiler drum 24 is cleaned, the rotation of the brush 72 is stopped; air is permitted to escape from the air bag 66 so as to permit the brush carriage 62 to retract; the brush tube 28 is withdrawn from the coiler furnace 22; and the opening in the coiler furnace 22 is closed. Since the single-brush cleaner 20 is located to the side of the production line and the brush tube 28 is completely withdrawn from the coiler furnace 22 when not in use, the single-brush cleaner 20 may be inspected and serviced (for example, the brush 72 may be changed) without interfering with the operation of the coiler furnace 22 or requiring that the coiler furnace 22 be permitted to cool.

Figure 10:
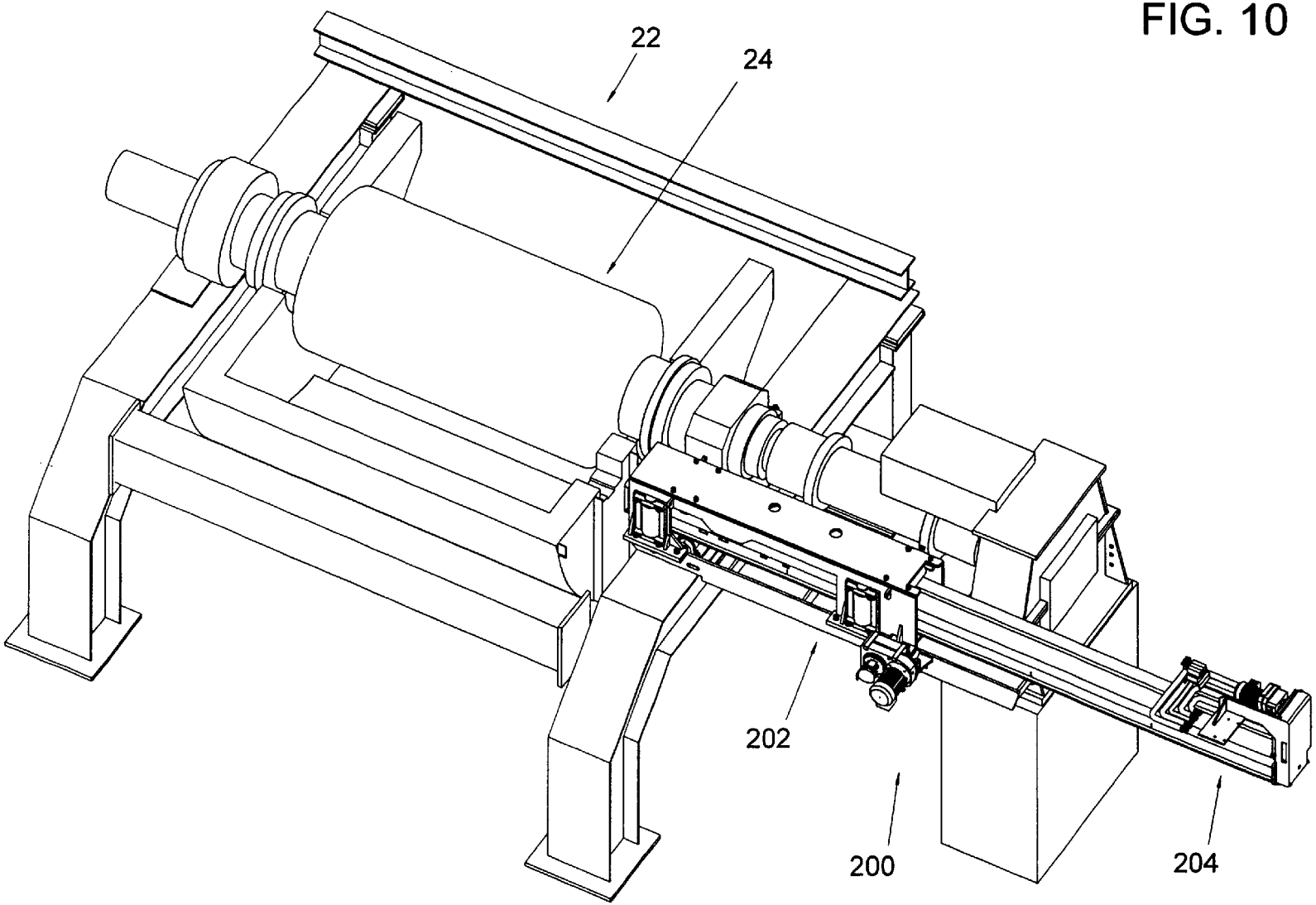
FIG. 10 is an isometric view of an exemplary dual-brush coiler drum cleaner embodiment of the present invention shown installed in association with a coiler furnace.
Figure 11:
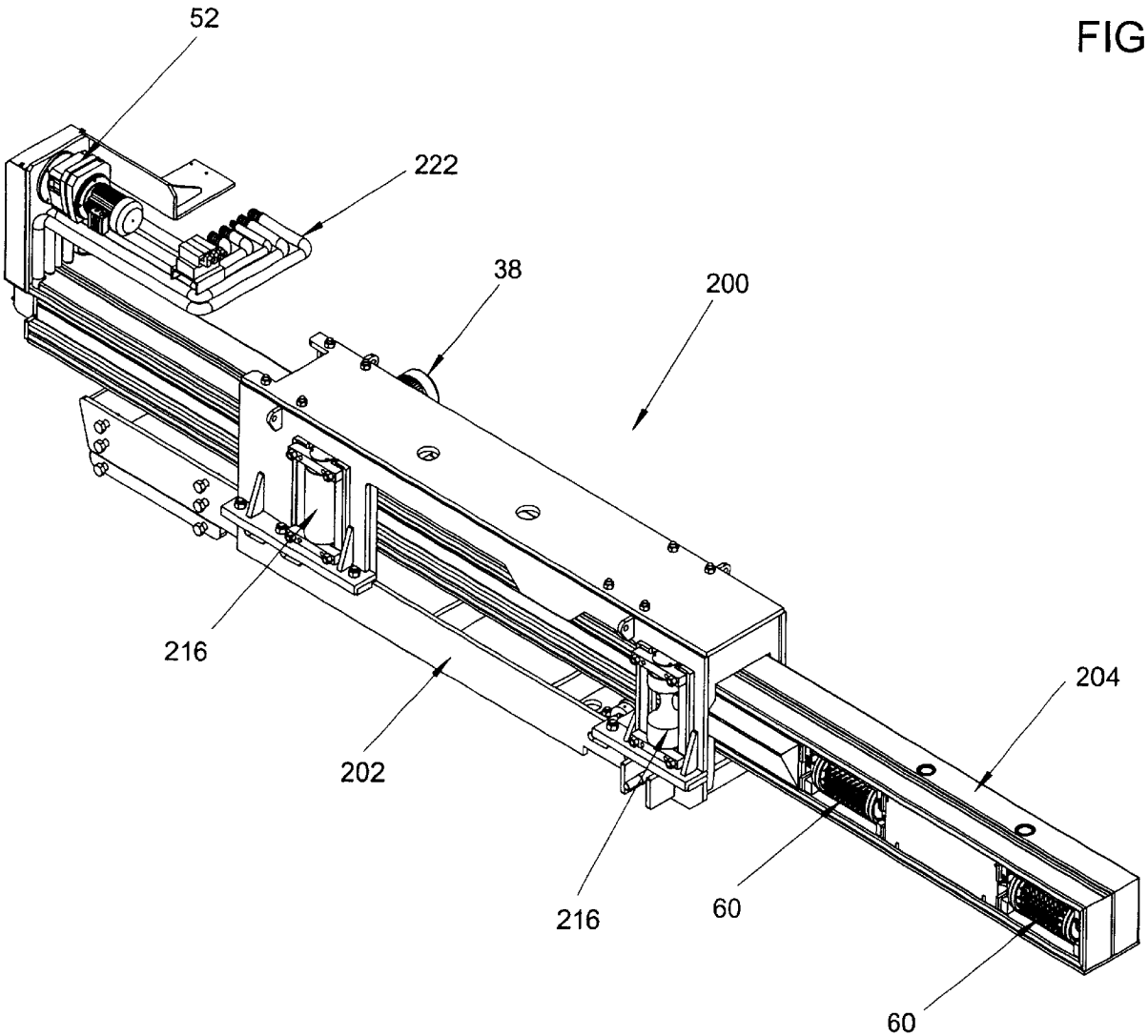
FIG. 11 is a rear isometric view of the embodiment shown in FIG. 10.

FIG. 10 shows an exemplary dual-brush cleaner 200 installed in association with a coiler furnace 22 (part cut-away in FIG. 10) for cleaning a coiler drum 24. As shown in FIG. 11, the dual-brush cleaner 200 includes a dual-brush frame 202 and a dual-brush tube 204 slidably mounted within the dual-brush frame 202. The dual-brush cleaner 200 is configured to be installed such that the dual-brush tube 204 enters the coiler furnace 22 at the side of the coiler drum 24, as shown in FIG. 10.

Figure 12:
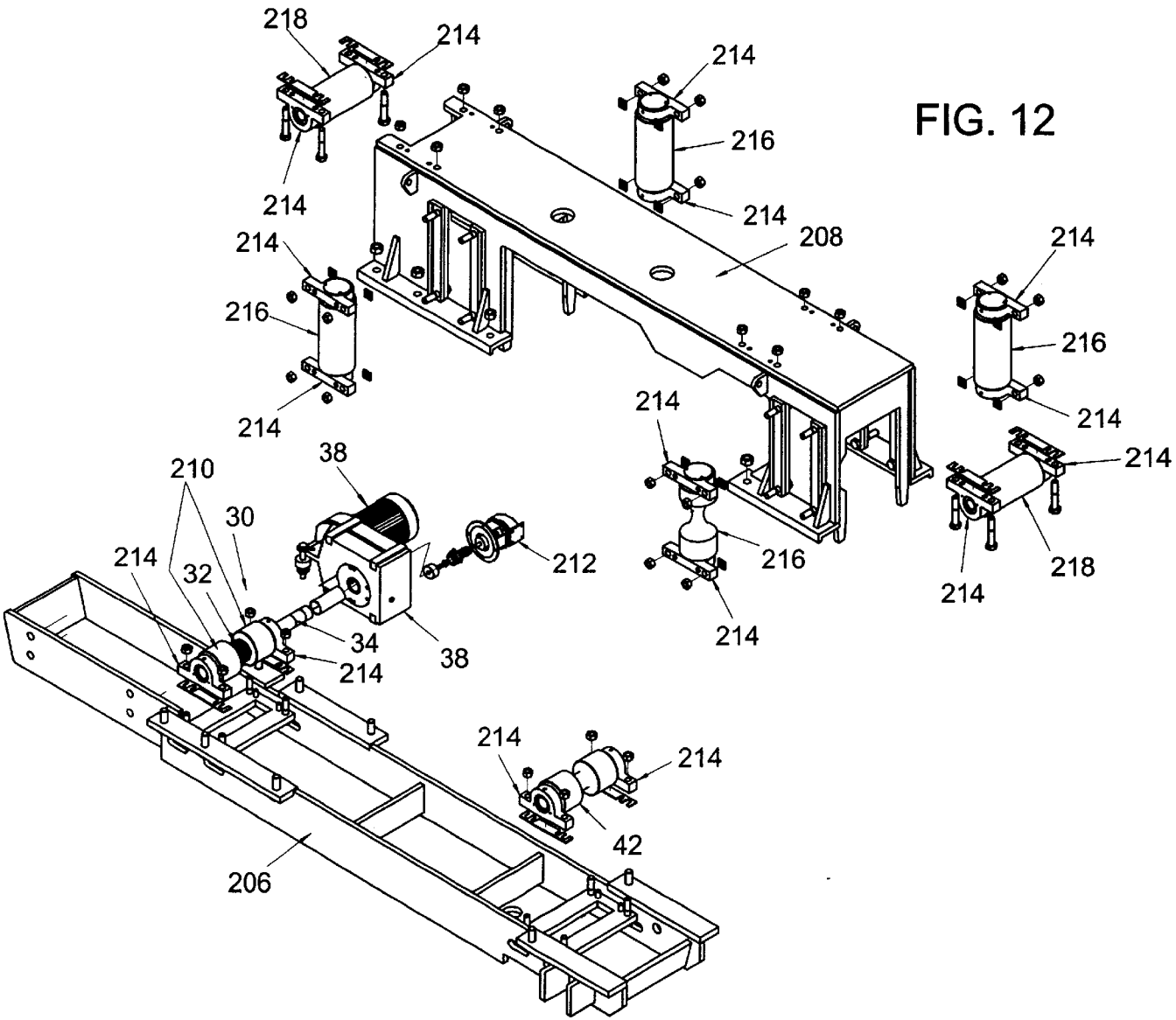
FIG. 12 is an exploded rear view of the dual-brush frame of the embodiment shown in FIG. 10.

As shown exploded in FIG. 12, the dual-brush frame 202 includes a base frame 206 and a shell frame 208. A pinion assembly 30 is mounted on the base frame 206. The pinion assembly 30 includes a pinion gear 32 mounted on a pinion shaft 34 between two pinion rollers 210. The pinion shaft 34 is connected to a pinion gearbox 36 which is connected to a pinion motor 38. A pulse pinion tachometer 212 is mounted on the pinion gearbox 36 for indicating the revolution rate of the pinion gear 32. The pinion shaft 34 is rotatably mounted on the base frame 206 with two bearing blocks 214. The pinion gear 32 engages a rack 40 attached to the dual-brush tube 204 for moving the dual-brush tube 204 within the dual-brush frame 202.

A base roller 42 is also rotatably mounted on the base frame 206 with two bearing blocks 214. The base roller 42 is spaced apart from, and aligned with, the pinion rollers 210 and has a profile similar to the pinion rollers 210 and pinion gear 32, in that the base roller 42 has a central "cut-away" portion to provide clearance for the rack 40.

Two sets of three rollers, each set of rollers comprising an opposed pair of side shell rollers 216 and a top shell roller 218, are rotatably mounted on the shell frame 208, each shell roller 216, 218 being mounted with two bearing blocks 214. The sets of shell rollers 216, 218 are spaced apart, in that one set of shell rollers 216, 218 is mounted proximate to one end of the shell frame 208, and the other set of shell rollers 216, 218 is mounted proximate to the other end of the shell frame 208. In use, the shell rollers 216, 218, pinion rollers 210 and base roller 42, support the dual-brush tube 204 and permit the dual-brush tube 204 to move longitudinally within the dual-brush frame 202.

Figure 13:
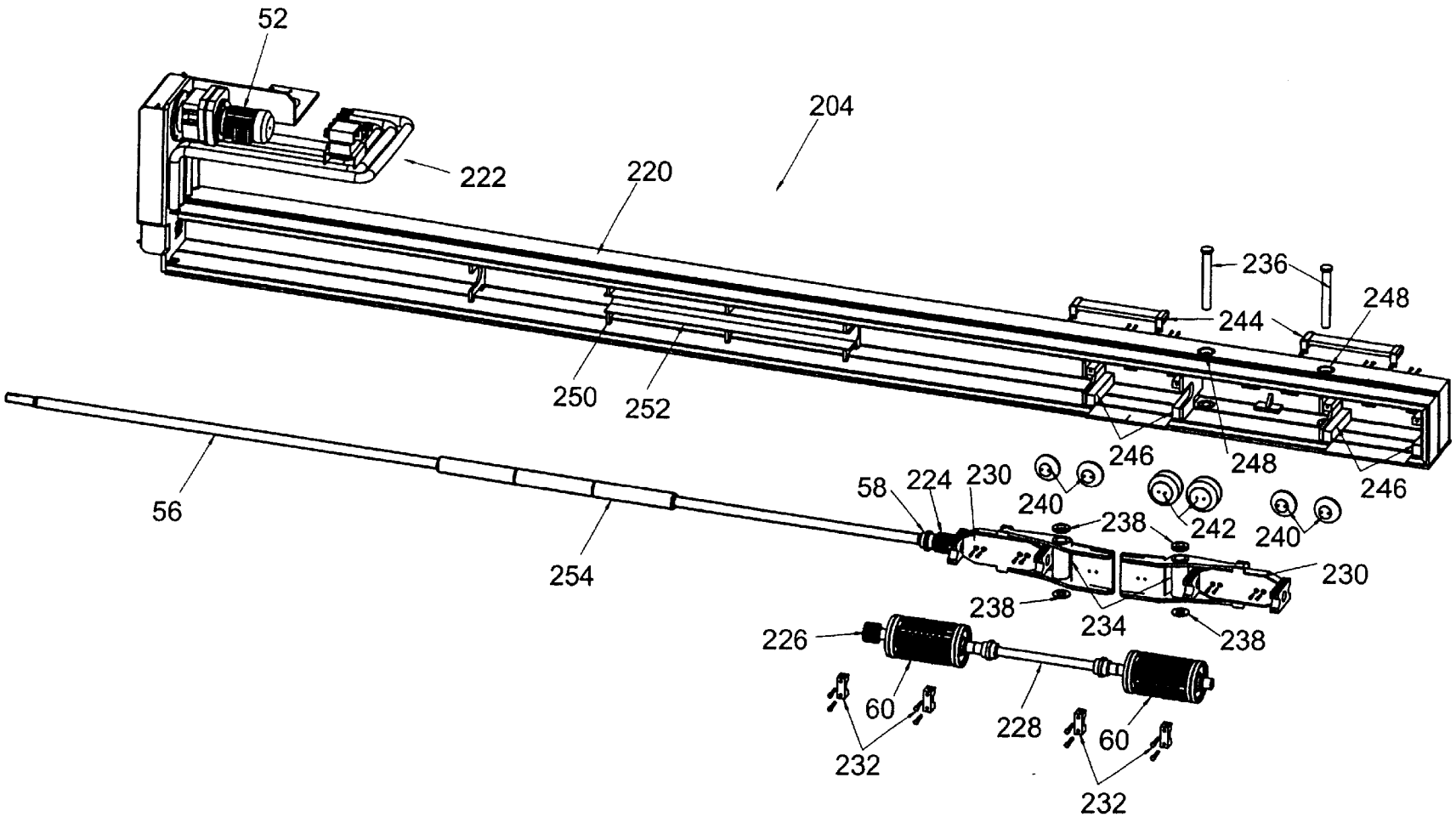
FIG. 13 is an exploded rear view of the dual-brush tube of the embodiment shown in FIG. 10.

FIG. 13 shows a partially-exploded, partially-cut-away view of the dual-brush tube 204. The dual-brush tube 204 includes a dual-brush tube body 220, water pipes 222, a brush motor 52, a brush drive shaft 56, a flexible coupling 58, a brush drive gear 224, a brush spur gear 226, two brush assemblies 60, a brush link shaft 228, two dual-brush carriages 230, four dual-brush brackets 232, two rocker arms 234, two pivot pins 236, four rocker arm washers 238, four projection air bags 240, two retraction air bags 242 and two cooling headers 244.

The dual-brush tube body 220 includes two sets of dual-brush carriage guides 246, four pivot pin holes 248 and the brush drive shaft support 250. The brush drive shaft support 250 includes a longitudinally-extending, U-shaped groove 252 that is open at each end. The groove 252 is sized to permit rotation of the brush drive shaft 56 within the groove 252. The U shape of the groove 252 permits some lateral movement of the brush drive shaft 56 so as to permit movement of the brush assemblies 60 during use.

Preferably, a sleeve 254 is located on the brush drive shaft 56 so as to be interposed between the brush drive shaft 56 and the groove 252 to protect against wear. An example of a suitable relatively-low-friction material for the sleeve 254, is NYLATRON™. Other materials may also be used.

The dual-brush tube body 220, is made, in part, from hollow rectangular tubes running the length of the brush tube body 220. Some of the water pipes 222 are in fluid communication with the interiors of some of the rectangular tubes and some of the interiors of the rectangular tubes are in fluid communication with the interiors of other rectangular tubes. In this way cooling water (or other cooling liquid) may be circulated through the water pipes 22 and interiors of the rectangular tubes, so as to cool the dual-brush tube 204 during use.

Figure 14:
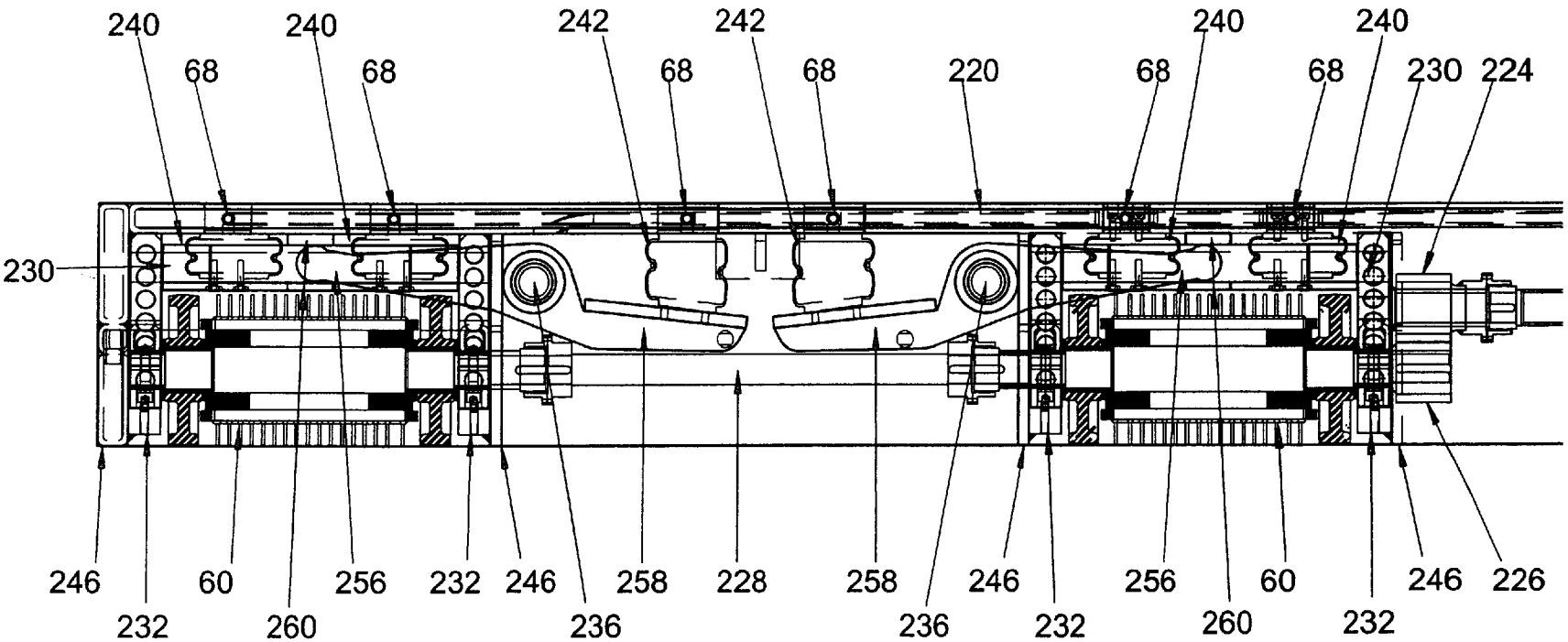
FIG. 14 is an enlarged-scale cut-away top plan view of the brush assemblies and adjacent components of the embodiment shown in FIG. 10.

As shown in FIG. 14, the brush assemblies 60 are each rotatably attached to a respective dual-brush carriage 230 with two dual-brush brackets 232. The dual-brush carriages 230 are slidably mounted within the dual-brush carriage guides 246. The brush assemblies 60 are connected, one to the other, by the brush link shaft 228. One brush assembly 60 is connected to the brush spur gear 226, which meshes with the brush drive gear 224. The brush drive gear 224 is connected to the brush drive shaft 56 via the flexible coupling 58 (not shown in FIG. 14). In use, rotation of the brush drive shaft 56 causes rotation of the brush drive gear 224, which causes rotation of the brush spur gear 226 and the brush assemblies 60.

The rocker arms 234 are each pivotally mounted on a respective pivot pin 236.

Each pivot pin 236 passes through a respective two pivot pin holes 248 and an associated two rocker arm washers 238, with one rocker arm washer 238 located on either side of each rocker arm 234. One rocker arm 234 is associated with one of the dual-brush carriages 230 and the other rocker arm 234 is associated with the other dual-brush carriage 234. One end of each rocker arm 234 has two spaced-apart fingers 256. The other end of each rocker arm 234 comprises a substantially-planar paddle 258. The distal end of each finger 256 is interposed between a pair of tabs 260 that project from the associated dual-brush carriage 230, such that pivoting each rocker arm 234 causes the associated dual-brush carriage 230 to move within the dual-brush carriage guides 246 substantially perpendicularly to the longitudinal axis of the dual-brush tube 204.

Two projection air bags 240 are interposed between each dual-brush carriage 230 and an adjacent interior wall of the dual-brush tube body 220. One retraction air bag 242 is interposed between each paddle 258 and an adjacent interior wall of the dual-brush tube body 220. The projection air bags 240 and retraction air bags 242 are conventional such air bags. An example of a suitable projection air bag 240 is the Firestone Air Bag, Style 25, P/N WO1-358-7047. An example of a suitable retraction air bag 242 is the Firestone Air Bag, Style 116, P/N WO1-358-7561. It will be clear that other commercially available air bags could be used. The projection air bags 240 and retraction air bags 242 are connected to pneumatic lines 68 for supplying compressed air to the projection air bags 240 and retraction air bags 242. Preferably, the pneumatic lines 68 run within the interior of one of the rectangular tubes making up the dual-brush tube body 220.

In use, supplying compressed air to the projection air bags 240 causes the projection air bags 240 to inflate and expand so as to push against the dual-brush carriages 230 and cause the brush assemblies 60 to move in the direction of increasing projection from the dual-brush tube body 220. Withdrawing compressed air from the projection air bags 240 or merely ceasing to supply compressed air to the projection air bags 240, so as to permit the projection air bags 240 to deflate, and supplying compressed air to the retraction air bags 242 causes the retraction air bags 242 to inflate and expand so as to push against the paddles 258, causing the rocker arms 234 to pivot so as to cause the dual-brush carriages 230 and associated brush assemblies 60 to move in the direction of decreasing projection from the dual-brush tube body 220 so as to retract the brush assemblies 60.

Figure 15:
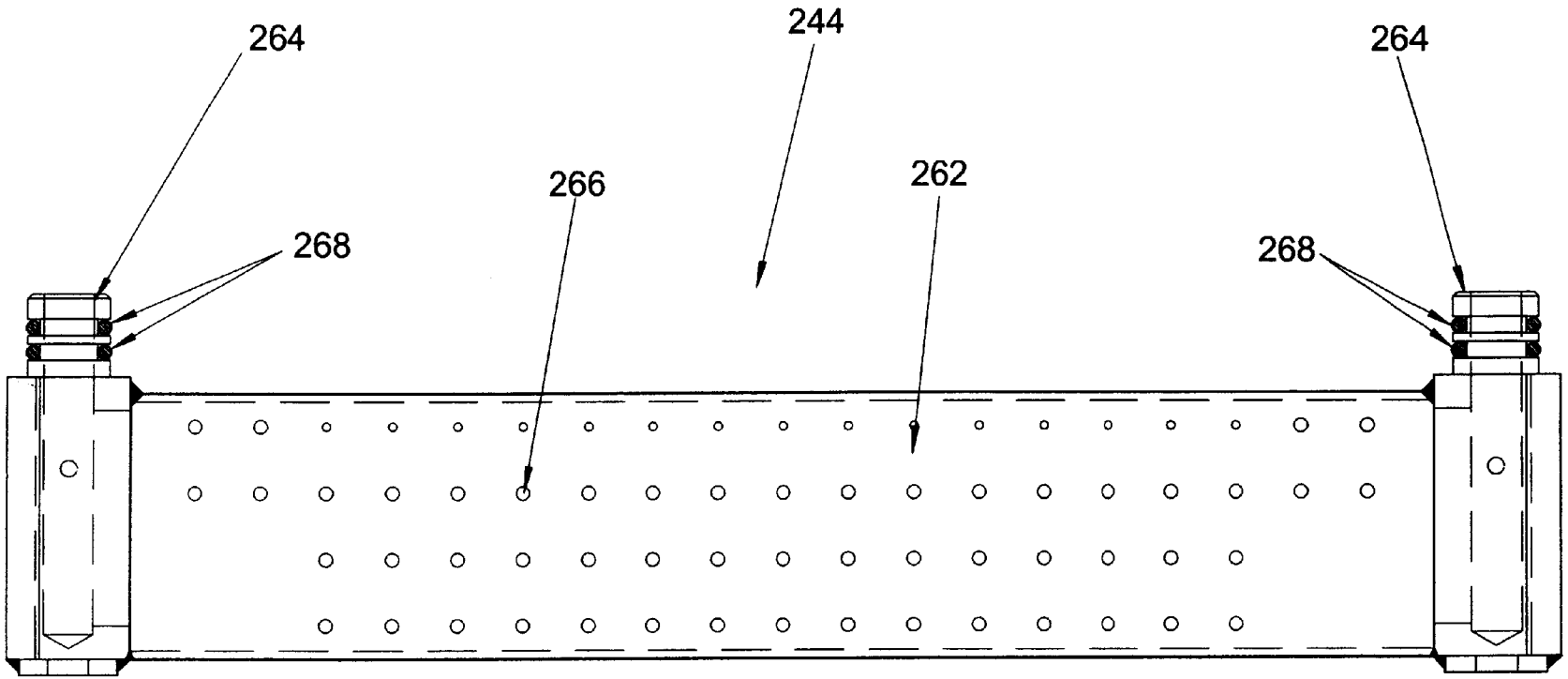
FIG. 15 is a bottom-plan view of a cooling header of the embodiment shown in FIG. 10.

Each cooling header 244 (shown in FIG. 15) comprises a hollow header body 262 and two nipples 264. One side of the header body 262 is perforated by a plurality of header holes 266. When in operational position: each cooling header 244 is secured with bolts(not shown) to a respective set of dual-brush carriage guides 246 such that the side of the header body 262 having the header holes 266 is adjacent the associated brush assembly 60; and the nipples 262 are inserted into sockets (not shown) in the interior of the dual-brush tube body 220 such that the interior of each cooling header 244 is in fluid communication with the interior of one or more of the rectangular tubes making up the dual-brush tube body 220. Conventional O-Rings 268 act to seal the joint between each nipple 264 and the associated socket. In use, water may be provided via the water pipes 22 and interiors of the rectangular tubes, so as to flow into each cooling header 244 via the nipples 264 and thence through the header holes 266 to shower on the brush assemblies 60 and adjacent components, so as to cool them.

During use, some of the water showered on the brush assemblies 60 and adjacent components may splash or drip into the coiler furnace 22. Because of the resulting cooling effect, it is desirable to minimize the amount of water lost into the coiler furnace 22. The interior of the dual-brush tube body 220 is configured to permit water to flow along the bottom of the interior of the brush tube body 220 from one end of the brush tube body 220 to the other. A drain hole (or drain holes) (not shown), located proximate to the end of the dual-brush tube body 220 opposite the end of the dual-brush tube body 220 housing the brush assemblies 60, permits water within the interior of the dual-brush tube body 220 to drain away. Preferably, the dual-brush cleaner 200 is installed such that the bottom of the interior of the dual-brush tube body 220 has a slight slope so as to promote the flow of water from the region of the brush assemblies 60 to the drain holes. In this way, during use, at least some of the water showered on the brush assemblies 60 and adjacent components will flow to the drain holes and will not flow into the coiler furnace 22.

The dual-brush cleaner 200 is used to clean a coiler drum 24 in a manner similar to the above-described single-brush cleaner 20. To clean the coiler drum 24, the dual-brush tube 204 is inserted into the coiler furnace 22. The brushes 72 are brought into contact with the surface of the coiler drum 24 and the brushes 72 are rotated to clean the coiler drum 24. Once the cleaning is complete, the dual-brush tube 204 is completely withdrawn from the coiler furnace 22.

Typically during the cleaning of the coiler furnace, water is provided to the dual-brush tube 204 via the water pipes 222 so as to circulate within at least some of the rectangular tubes making up the dual-brush tube body 220, and to flow to the cooling headers 244 and thus to shower on to the brush assemblies 60 and adjacent components. Typically, some portion of the water showered on to the brush assemblies 60 is lost into the coiler furnace 22 and some of the water flows within the dual-brush tube body 204 to the water drains.

In use, a removable tray, not shown, may be positioned under each of the brushes 72 to receive detritus falling into the dual-brush tube 204, so as to permit such detritus to be easily removed from the dual-brush tube 204 after a cleaning operation, by removing the tray and cleaning it.

Figure 16:
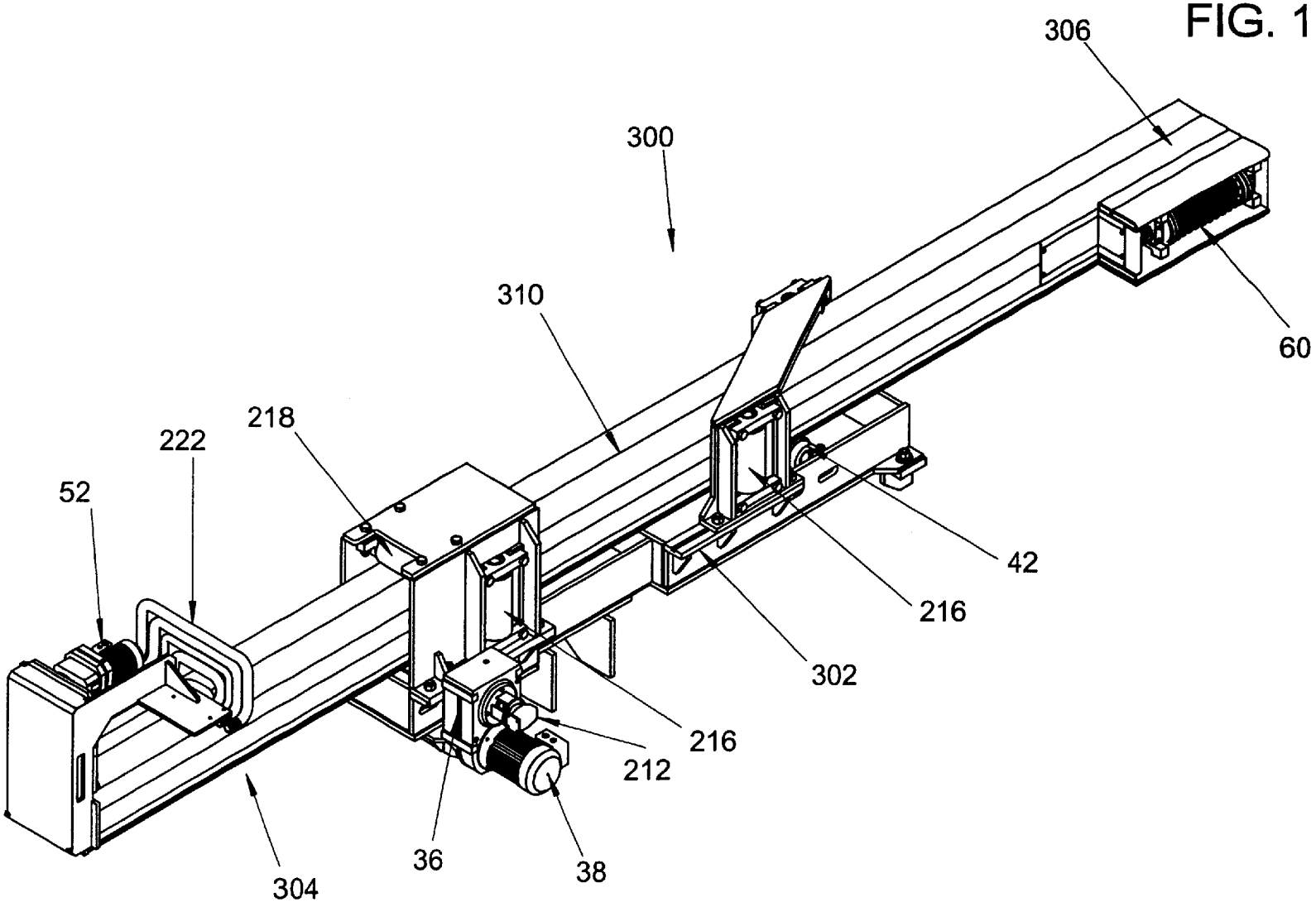
FIG. 16 is an isometric view of an exemplary projecting-end coiler drum cleaner embodiment of the present invention.

FIG. 16 shows an exemplary projecting-end cleaner 300, comprising an offset-roller frame 302 and a projecting-end tube 304 having a projecting cleaning end 306 housing a single brush assembly 60.

The offset-roller frame 302 includes two sets of rollers, similar to the rollers in the above-described dual-brush cleaner 200, except that the set of rollers closest to the projecting cleaning end 306 does not include a top shell roller 218 and comprises only a base roller 52 and two side shell rollers 216. Further, one side shell roller 216 in the set of rollers closest to the projecting cleaning end 306 is set back to accommodate the projecting cleaning end 200. Preferably, an auxiliary roller (not shown) is positioned to support the end of the projecting-end tube 304 opposite the projecting cleaning end 306, when the projecting-end tube 304 is withdrawn from the coiler furnace 22.

The offset roller frame 302 includes a pinion gear 32 (not visible in FIG. 16) driven by a pinion motor 38 via a pinion gearbox 36. The pinion gear 32 engages a rack 40 (not visible in FIG. 16) on the projecting-end tube 304 for moving the projecting-end tube 304 longitudinally within the offset-roller frame 302. A pinion tachometer 212 is mounted on the pinion gearbox 36 for showing the rate of rotation of the pinion gear 32.

The projecting-end tube 304 includes a projecting-end tube body 310, a brush motor 52, a chain and sprocket assembly 54 (not visible in FIG. 16), a brush drive shaft 56 (not visible in FIG. 16), water pipes 222 and pneumatic lines 68 (not visible in FIG. 16. The projecting-end tube body 310 is made in part of rectangular tubes. Some of the water pipes 222 are connected to the rectangular tubes such that water may be circulated in the rectangular tubes during the cleaning operation so as to cool the projecting-end tube 304.

Figure 17:
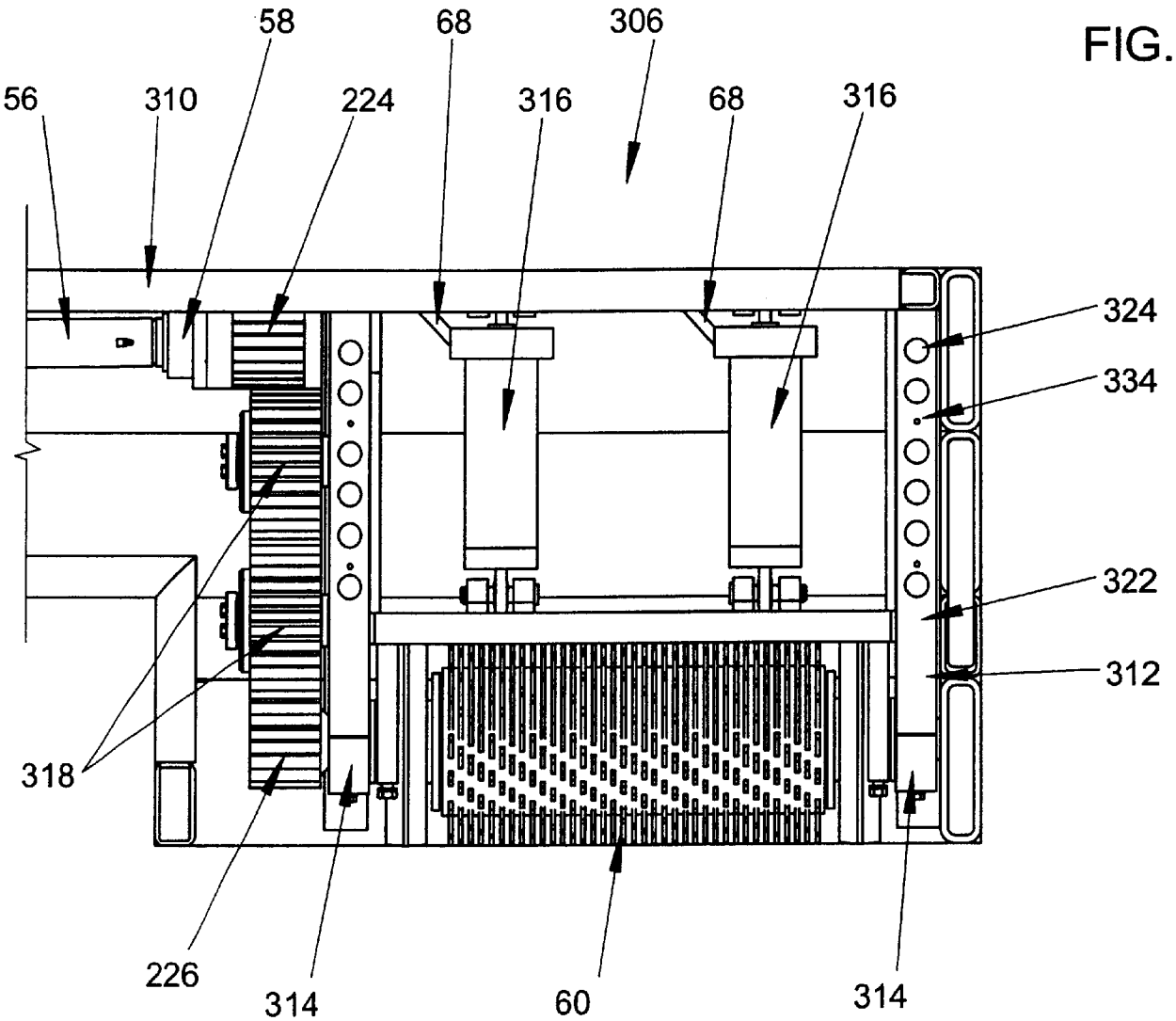
FIG. 17 is an enlarged-scale cut-away top-plan view of the cleaning end of the brush tube of the embodiment shown in FIG. 16, with the carriage header and some other related cooling components removed for clarity.

As shown in FIG. 17, the projecting cleaning end 306 houses: a brush assembly 60 rotatably mounted in a cooled carriage 312 with two cooled carriage brackets 314; two pneumatic rams 316 interposed between and connected to the cooled carriage 312 and an interior wall of the projecting-end tube body 310; a brush spur gear 226 attached to the brush assembly 60, a bush drive gear 224 rotatably mounted on the cooled carriage 312 and connected to the brush drive shaft 56 via a flexible coupling 58; and two brush idler gears 318 rotatably mounted to the cooled carriage 312, engaged one with the other, and interposed between and engaged with the brush drive gear 224 and the brush spur gear 226, such that rotation of the brush drive shaft 56 rotates the gears 224, 318, 226 and thus the brush assembly 60.

The cooled carriage 312 is slidably mounted between the guide rails 320. The slide surfaces 322, being those surfaces of the cooled carriage 312 abutting the guide rails 320, preferably include slightly-projecting wear buttons 324 to reduce the amount of direct contact between the slide surfaces 322 and the guide rails 320 so as to reduce wear caused by relative movement of the cooled carriage 312 and the guide rails 320. An example of an appropriate wear button 324 is the HYCOMP™ Wear Button. Other commercially available wear buttons could be used. The wear buttons 324 are pressed into appropriate holes in the slide surfaces 322. Preferably, the slide surfaces 322 are clad with a suitable relatively-low-friction material such as bronze.

Compressed air may be supplied to, or withdrawn from, the pneumatic rams 316 via the pneumatic lines 68. The cooled carriage 312 may be moved in the directions of increasing or decreasing projection from the projecting-end tube body 310 by, respectively, supplying air to, or withdrawing air from, the pneumatic rams 316.

Figure 18:
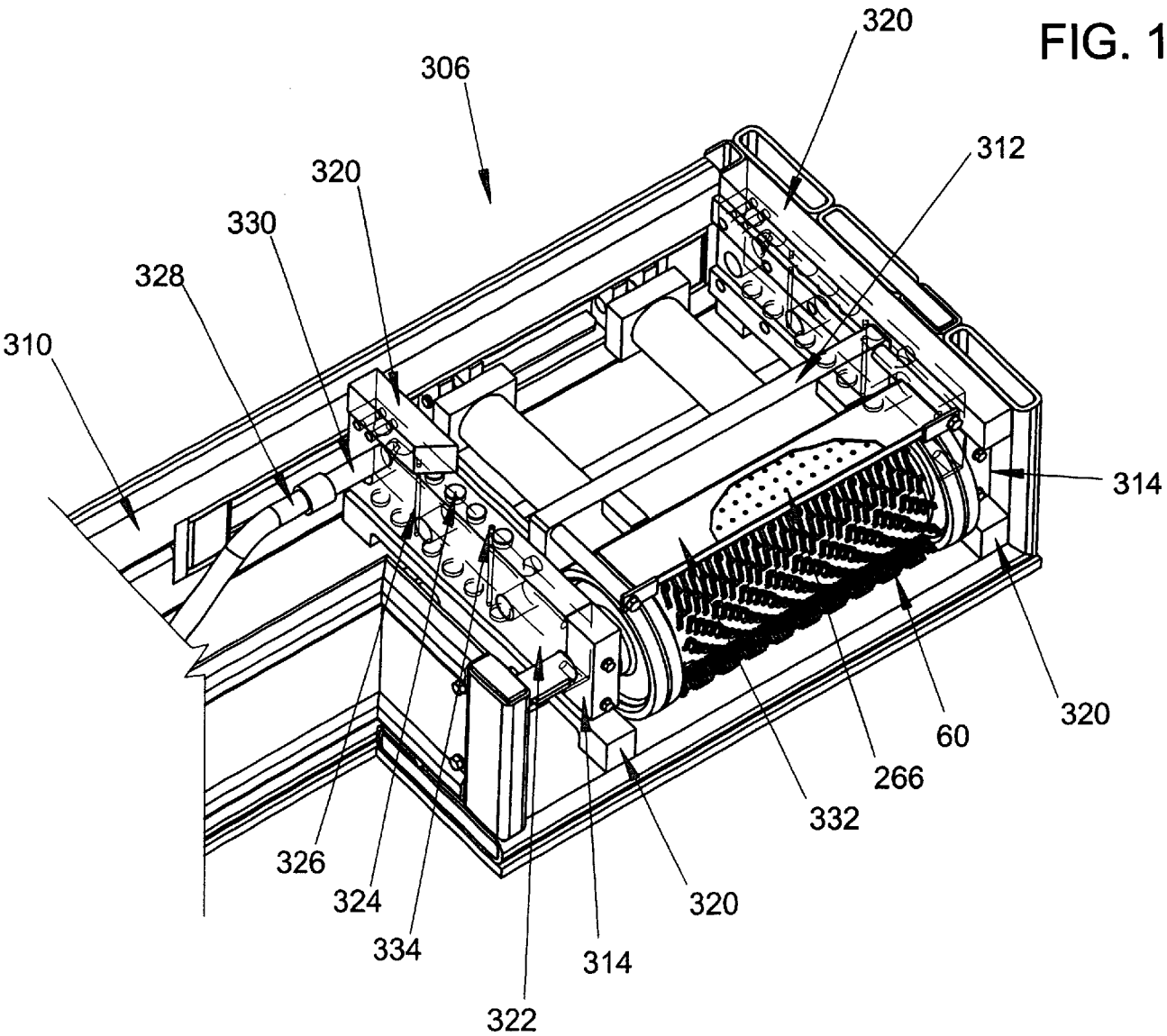
FIG. 18 is a cut-away isometric view of the cleaning end of the brush tube of the embodiment shown in FIG. 16, showing channels for cooling liquid by dashed lines, and with the gears and other related drive components removed for clarity.

As shown in FIG. 18, the cooled carriage 312 has several internal channels 326 (indicated with dashed lines) for conducting water (or other suitable cooling liquid) within and through the cooled carriage 312. For clarity in showing the channels 326, the brush spur gear 226, brush drive gear 224, brush idler gears 318 and associated drive components are not shown in FIG. 18. During use, water may be provided to the channels 326 via a water line (not shown) running the length of the projecting-end tube 304 and connected to the flexible hose 328. The flexible hose 328 is connected to the inlet stub 330, which is mounted on the cooled carriage 312 and which is in fluid communication with the channels 326. The water line is connected to the inlet stub 330 via the flexible hose 328 so as to permit the cooled carriage 312 to move relative to the water line.

A carriage header 332 (similar to the above-described cooling headers 244) is mounted on, and moves with, the cooled carriage 312. The interior of the carriage header 332 is in fluid communication with the channels 326 via carriage header nipples (not shown, similar to nipples 152), inserted into cooled carriage sockets (not shown) in the cooled carriage 312. In use water may be provided to the carriage header 332 to shower on the brush assemblies 60 and adjacent components, so as to cool them.

Some of the channels 326 run to openings on the slide surfaces 322, referred to herein as cooling ports 334, such that during use, if water is provided to the channels 326, some of the water will flow out of the cooling ports 334 into the joints between the slide surfaces 322 and the guide rails 320 so as to cool the slide surfaces 322 and guide rails 320 and possibly partially lubricate the joints between them.

The projecting-end cleaner 300 is used in a manner similar to the above-described single-brush cleaner 20 and dual-brush cleaner 200.

What is claimed is:

1. A coiler drum cleaner, for use in removing unwanted matter from a rotating drum in a coiler furnace, the drum having a work surface extending over a drum length, the coiler drum cleaner comprising:

a) a rotatable cleaning element, engageable with unwanted matter on the work surface, that rotates when in use to remove the unwanted matter;

b) insertion means supporting the cleaning element, for retractably inserting the cleaning element into the coiler furnace;

c) biasing means operable to bias the cleaning element to move from a rest position out of contact with the work surface toward and into close proximity with the work surface; and d) means for rotating the cleaning element when it is in close proximity with the work surface;

wherein, when in use, the cleaning element is rotated and moved into close proximity with the work surface for removing unwanted matter from the work surface.

2. The coiler drum cleaner of claim 1, wherein the cleaning element is a brush whose configuration, dimensions and material of composition are selected for cleaning efficacy and durability.

3. The coiler drum cleaner of claim 1, wherein the brush includes a plurality of projecting steel tines.

4. The coiler drum cleaner of claim 1, wherein the tines are carbide tipped.

5. The coiler drum cleaner of claim 2, wherein the brush is substantially cylindrical.

6. The coiler drum cleaner of claim 2, wherein the axis of rotation of the brush is substantially parallel to the axis of rotation of the drum.

7. The coiler drum cleaner of claim 1, wherein the means for rotating the cleaning element rotates the cleaning element, when operating, in the same direction of rotation as the drum when viewed from the same direction along their axes of rotation, so that the adjacent portions of the cleaning element and drum move in opposite directions relative to each other.

8. The coiler drum cleaner of claim 1, wherein the insertion means comprises means for moving the cleaning element axially relative to the drum.

9. The coiler drum cleaner of claim 8, wherein the insertion means comprises:

a) a cleaner frame, in use installed adjacent to the coiler furnace; and b) a longitudinally-extending cleaning element support member having an insertion end for insertion into the coiler furnace and supporting the cleaning element proximate to the insertion end, the cleaning element support member supported by the cleaner frame and axially displaceable relative to the cleaner frame; and c) means for axially displacing the cleaning element support member relative to the cleaner frame;

wherein, the insertion end of the cleaning element support member and the cleaning element are axially retractably insertable into the coiler furnace by axial displacement of the cleaning element support member relative to the cleaner frame.

10. The coiler drum cleaner of claim 9, wherein the means for rotating the cleaning element comprises:

a) a drive shaft drivingly coupled to the cleaning element; and b) a motor mounted on the cleaning element support member and drivingly coupled to the drive shaft.

11. The coiler drum cleaner of claim 1, wherein the biasing means comprises means for radially displacing the cleaning element relative to the cleaning element support member.

12. The coiler drum cleaner of claim 11, wherein the means for radially displacing the cleaning element comprises:

c) a carriage to which the cleaning element is rotatably mounted, the carriage being radially-movably mounted proximate to the insertion end of the cleaning element support member, such that the carriage is radially reversibly displaceable relative to the cleaning element support member toward the work surface; and b) means for displacing the carriage and cleaning element radially relative to the cleaning element support member towards the work surface.

13. The coiler drum cleaner of claim 12, further comprising at least one depth guide mounted to the carriage for impeding movement of the brush radially towards the work surface from a selected radial proximity to the work surface, selected for removing unwanted matter from the work surface while minimizing damage to the brush.

14. The coiler drum cleaner of claim 13, wherein the depth guide is circular, and is mounted concentric with the axis of rotation of the brush and is free to rotate relative to the brush.

15. The coiler drum cleaner of claim 14, wherein the diameter of the depth guide is no more than about equal to the diameter of the brush.

16. The coiler drum cleaner of claim 15, comprising two depth guides, one depth guide mounted to the carriage proximate to one end of the brush and the other depth guide mounted to the carriage proximate to the other end of the brush.

17. The coiler drum cleaner of claim 16, wherein the diameter of the depth guides is no more than about equal to the diameter of the brush.

18. A coiler drum cleaner, for use in removing unwanted matter from a rotating drum in a coiler furnace, the drum having a work surface extending over a drum length, the coiler drum cleaner comprising:

a) a cleaning element engageable with unwanted matter on the work surface for removing the unwanted matter;

b) insertion means, supporting the cleaning element, for retractably inserting the cleaning element into the coiler furnace;

c) biasing means operable to bias the cleaning element to move from a rest position out of contact with the work surface toward and into close proximity with the work surface; and d) cleaning movement means for moving the cleaning element axially relative to the drum over a path of travel sufficient to cover the drum length;

wherein, when in use, the cleaning element is movable into close proximity to the work surface along the drum length so as to bring the cleaning element into contact with different portions of the work surface along the drum length.

19. The coiler drum cleaner of claim 18, wherein the axial length of the cleaning element is less than the drum length.

20. The coiler drum cleaner of claim 18, wherein the axial length of the cleaning element is no more than about half of the drum length.

21. The coiler drum cleaner of claim 18, wherein the insertion means comprises means for axially moving the cleaning element.

22. The coiler drum cleaner of claim 21, wherein the insertion means and cleaning movement means comprise:

a) a cleaner frame, in use installed adjacent to the coiler furnace;

b) a longitudinally-extending cleaning element support member, having an insertion end for insertion into the coiler furnace and supporting the cleaning element proximate to the insertion end, the cleaning element support member supported by the cleaner frame and axially displaceable relative to the cleaner frame; and c) means for axially displacing the cleaning element support member relative to the cleaner frame;

wherein, the cleaning element is both axially retractably insertable into the coiler furnace and axially moveable over a path of travel sufficient to cover the drum length, by axial displacement of the cleaning element support member relative to the cleaner frame.

23. The coiler drum cleaner of claim 22, wherein the means for axially displacing the cleaning element support member relative to the cleaner frame, comprises:

a) a rack mounted to one of the cleaning element support member and the cleaner frame;

b) a pinion rotatably mounted to the other of the cleaning element support member and the cleaner frame assembly, and engaging the rack; and c) means for rotating the pinion.

24. The coiler drum cleaner of claim 22, wherein the biasing means comprises means for radially displacing the cleaning element relative to the cleaning element support member.

25. The coiler drum cleaner of claim 24, wherein the means for radially displacing the cleaning element comprises:

d) a carriage to which the cleaning element is mounted, the carriage being radially-movably mounted to the cleaning element support member, such that the carriage and cleaning element are radially displaceable relative to the cleaning element support member; and b) means for moving the carriage and cleaning element radially towards the work surface relative to the cleaning element support member.

26. The coiler drum cleaner of claim 18, wherein the cleaning element is rotatable and rotates when in use to remove unwanted matter from the work surface.

27. The coiler drum cleaner of claim 26, wherein the cleaning element is a brush whose configuration, dimensions and material of composition are selected for cleaning efficacy and durability.

28. The coiler drum cleaner of claim 27, wherein the brush is substantially cylindrical and includes an array of projecting, carbide-tipped, steel tines.

29. The coiler drum cleaner of claim 27, wherein the axis of rotation of the brush is substantially parallel to the axis of rotation of the drum.

30. The coiler drum cleaner of claim 18, further comprising means for cooling the cleaning element support member.

31. The coiler drum cleaner of claim 30, wherein the cooling means comprises a cavity within the cleaning element support member suitable for containing cooling liquid.

32. The coiler drum cleaner of claim 30, wherein the cooling means comprises passages in the cleaning element support member for circulating cooling liquid within the cooling element support member.

33. A coiler drum cleaner, for use in removing unwanted matter from a rotating drum in a coiler furnace, the drum having a work surface extending over a drum length, the coiler drum cleaner comprising:

a) a cleaning element engageable with unwanted matter on the work surface for removing the unwanted matter;

b) axially moving means, supporting the cleaning element, for moving the cleaning element axially so as to, when in use, retractably insert the cleaning element into the coiler furnace and move the cleaning element over a path of travel sufficient to cover the drum length; and c) biasing means operable to bias the cleaning element to move from a rest position out of contact with the work surface toward and into close proximity with the work surface;

wherein, when in use, the cleaning element is movable in close proximity to the work surface along the drum length so as to bring the cleaning element into contact with different portions of the work surface along the drum length.

34. The coiler drum cleaner of claim 33, wherein the axially moving means comprises:

a) a cleaner frame, in use installed adjacent to the coiler furnace;

b) a longitudinally-extending cleaning element support member, having an insertion end for insertion into the coiler furnace and supporting the cleaning element proximate to the insertion end, the cleaning element support member supported by the cleaner frame and axially displaceable relative to the cleaner frame; and c) means for axially displacing the cleaning element support member relative to the cleaner frame;

wherein, the cleaning element is both axially retractably insertable into the coiler furnace and axially moveable over a path of travel sufficient to cover the drum length, by axial displacement of the cleaning element support member relative to the cleaner frame.

35. The coiler drum cleaner of claim 34, wherein the cleaner element support member is a substantially-rectangular, tubular member.

36. The coiler drum cleaner of claim 34, wherein the cleaner frame comprises two spaced-apart sets of rollers, that contact the cleaning element support member so as to support the cleaning element support member and permit the cleaning element support member to be axially displaced relative to the cleaner frame.

37. The coiler drum cleaner of claim 34, wherein the biasing means comprises:

a) a carriage to which the cleaning element is mounted, the carriage being radially-movably mounted to the cleaning element support member, such that the carriage and cleaning element are reversibly radially displaceable relative to the cleaning element support member towards the work surface; and b) means for radial displacing the carriage and cleaning element relative to the cleaning element support member towards the work surface.

38. The coiler drum cleaner of claim 37, wherein the means for radial displacing the carriage and cleaning element comprises a reversibly expandible device interposed between the carriage and the cleaning element support member.

39. The coiler drum cleaner of claim 38, wherein, the interior of the expandible device is in fluid communication with a source of pressurized fluid and the expandible device expands responsive to the provision of pressurized fluid to the interior of the expandible device.

40. The coiler drum cleaner of claim 39, wherein the expandible device is a pneumatic bag.

41. The coiler drum cleaner of claim 39, wherein the expandible device is a ram.

42. The coiler drum cleaner of claim 37, further comprising means for moving the cleaning element radially away from the work surface.

43. The coiler drum cleaner of claim 42, wherein the means for moving the cleaning element away from the work surface comprises a ram interposed between and attached to the carriage and the cleaning element support member.

44. The coiler drum cleaner of claim 42, wherein the means for moving the cleaning element away from the work surface comprises:

a) a rocker arm, pivotally mounted to the cleaning element support member, and having a first end and a second end, the first end engaging the carriage; and b) a reversibly expandible pneumatic bag interposed between the second end and the cleaning element support member;

wherein, expanding the pneumatic bag causes the rocker arm to pivot so as to move the carriage and cleaning element away from the work surface.

45. The coiler drum cleaner of claim 34, further comprising means for cooling the cleaning element support member.

46. The coil drum of claim 45, wherein the cooling means comprises a cavity within the cleaning element support member suitable for containing cooling liquid.

47. The coiler drum cleaner of claim 46, wherein the cooling means comprises passages in the cleaning element support member for circulating cooling liquid within the cooling element support member.

48. The coiler drum cleaner of claim 47, wherein the cleaning element support member comprises longitudinally-extending rectangular tubes and the passages for circulating cooling liquid comprise the interiors of the tubes.

49. The coiler drum cleaner of claim 40, wherein the cooling means comprises a header for showering cooling liquid onto the cleaning element.

50. The coiler drum cleaner of claim 49, further comprising means for conducting cooling liquid showered on the cleaning element out of the coiler furnace.

51. The coiler drum cleaner of claim 50, wherein the means for conducting water out of the cleaning element support member comprises:

a) a drain hole proximate to the end of the cleaning element support member opposite the insertion end of the cleaning element support member; and b) a path, within the cleaning element support member, for water to flow from the cleaning end to the drain hole.

52. The coiler drum cleaner of claim 51, wherein the path is sloped to promote the flow of liquid to the drain hole.

53. The coiler drum cleaner of claim 45, wherein:

a) the cleaning element support member includes guide rails for guiding the movement of the carriage;

b) the carriage includes slide surfaces that abut the guide rails and slide along the guide rails during movement of the carriage; and c) the cooling means includes channels within the carriage running to cooling ports on the slide surfaces for providing a cooling liquid to the slide surfaces.

54. The coil drum cleaner of claim 33, wherein the cleaning element is rotatable and rotates when in use to remove unwanted matter from the work surface.

55. The coiler drum cleaner of claim 54, wherein the cleaning element is a brush whose configuration, dimensions and material of composition are selected for cleaning efficacy and durability.

56. The coiler drum cleaner of claim 55, wherein the brush is substantially cylindrical and includes an array of projecting, carbide-tipped, steel tines.

57. The coiler drum cleaner of claim 56, wherein the axis of rotation of the brush is substantially parallel to the axis of rotation of the drum.

58. The coiler drum cleaner of claim 55, further comprising:

a) a second carriage, the second carriage being radially-movably mounted to the cleaning element support member, such that the second carriage is reversibly radially displaceable relative to the cleaning element support member towards the work surface;

b) a second cleaning element, mounted to the second carriage, drivingly coupled to the brush such that the second cleaning element and brush have a common axis of rotation; and c) means for radial displacing the second carriage and second cleaning element relative to the cleaning element support member towards the work surface.

59. A coiler drum cleaner, for use in removing unwanted matter from a rotating drum in a coiler furnace, the drum having a work surface extending over a drum length, the coiler drum cleaner comprising:

a) a cleaner frame, installed adjacent to the coiler furnace;

b) a longitudinally-extending cleaning element support member having an insertion end for insertion into the coiler furnace, the cleaning element support member being supported by the cleaner frame and axially displaceable relative to the cleaner frame, wherein the insertion end of the cleaning element support member is axially retractably insertable into the coiler furnace and movable axially along the work surface over the drum length;

c) axial moving means for axially displacing the cleaning element support member relative to the cleaner frame;

d) a carriage, radially-movably mounted to the cleaning element support member proximate to the insertion end of the cleaning element support member, such that the carriage is reversibly radially displaceable relative to the cleaning element support member towards the work surface;

e) a rotatable cleaning element engageable with unwanted matter on the work surface, rotatably mounted to the carriage;

f) means for radially displacing the carriage and cleaning element relative to the cleaning element support member toward the work surface, operable to bias the cleaning element to move from a rest position out of contact with the work surface toward and into close proximity with the work surface; and g) a motor, mounted on the cleaning element support member and drivingly coupled to the cleaning element, for rotating the cleaning element;

wherein, when the coiler drum cleaner is used to remove unwanted matter from the work surface, the insertion end of the cleaning element support member is inserted into the coiler furnace; the cleaning element is caused to rotate and is moved into close proximity with the work surface; and the cleaning end is moved along the drum length.

60. The coiler drum cleaner of claim 59, wherein the cleaning element support member is movably mounted to the cleaner frame by two spaced-apart sets of rollers rotatably mounted on the cleaner frame, the rollers engaging the cleaning element support member so as to permit axial movement of the cleaning element support member and impede radial movement of the cleaning element support member.

61. The coiler drum cleaner of claim 59, wherein the means for axially displacing the cleaning element support member relative to the cleaner frame, comprises:

a) a rack mounted to one of the cleaning element support member and the cleaner frame;

b) a pinion rotatably mounted to the other of the cleaning element support member and the cleaner frame, and engaging the rack; and c) means for rotating the pinion.

62. The coiler drum cleaner of claim 59, wherein the cleaning element is a brush whose configuration, dimensions and material of composition are selected for cleaning efficacy and durability.

63. The coiler drum cleaner of claim 62, wherein the brush includes a plurality of projecting steel tines.

64. The coiler drum cleaner of claim 63, wherein the tines are carbide tipped.

65. The coiler drum cleaner of claim 62, wherein the brush is substantially cylindrical.

66. The coiler drum cleaner of claim 65, wherein the axis of rotation of the brush is substantially parallel to the axis of rotation of the drum.

67. The coiler drum cleaner of claim 62, further comprising at least one depth guide mounted to the carriage for impeding movement of the brush radially towards the work surface from a selected cleaning position.

68. The coiler drum cleaner of claim 67, wherein the depth guide is circular, and is mounted concentric with the axis of rotation of the brush and is free to rotate relative to the brush.

69. The coiler drum cleaner of claim 68, wherein the diameter of the depth guide is no more than about equal to the diameter of the brush.

70. The coiler drum cleaner of claim 62, comprising two depth guides, one depth guide mounted to the carriage proximate to one end of the brush and the other depth guide mounted to the carriage proximate to the other end of the brush.

71. The coiler drum cleaner of claim 70, wherein the diameter of the depth guides is no more than about equal to the diameter of the brush.

72. The coiler drum cleaner of claim 62, further comprising:

a) a second carriage, the second carriage being radially-movable mounted to the cleaning element support member, such that the second carriage is reversibly radially displaceable relative to the cleaning element support member towards the work surface;

b) a second cleaning element, mounted to the second carriage, drivingly coupled to the brush such that the second cleaning element and brush have a common axis of rotation;

c) means for radial displacing the second carriage and second cleaning element relative to the cleaning element support member towards the work surface.

73. The coiler drum cleaner of claim 59, wherein the axis length of the cleaning element is less than the drum length.

74. The coiler drum cleaner of claim 59, wherein the axis length of the cleaning element is no more than about half of the drum length.

75. The coiler drum cleaner of claim 59, wherein the means for radially displacing the carriage relative to the cleaning element support member comprises an expandible device interposed between the carriage and the cleaning element support member.

76. The coiler drum cleaner of claim 74, wherein, the interior of the expandible device is in fluid communication with a source of pressurized fluid and the expandible device expands responsive to the provision of pressurized fluid to the interior of the expandible device.

77. The coiler drum cleaner of claim 76, wherein the expandible device is a pneumatic bag.

78. The coiler drum cleaner of claim 76, wherein the expandible device is a ram.

79. The coiler drum cleaner of claim 75, further comprising means for moving the cleaning element radially away from the work surface.

80. The coiler drum cleaner of claim 78, wherein the means for moving the cleaning element away from the work surface comprises a ram interposed between and attached to the carriage and the cleaning element support member.

81. The coiler drum cleaner of claim 79, wherein the means for moving the cleaning element away from the work surface comprises:

a) a rocker arm, pivotally mounted to the cleaning element support member, and having a first end and a second end, the first end engaging the carriage; and b) a reversibly expandible pneumatic bag interposed between the second end and the cleaning element support member;

wherein, expanding the pneumatic bag causes the rocker arm to pivot so as to move the carriage and cleaning element away from the work surface.

82. The coiler drum cleaner of claim 59, further comprising means for cooling the cleaning element support member.

83. The coiler drum cleaner of claim 82, wherein the cooling means comprises a cavity within the cleaning element support member suitable for containing cooling liquid.

84. The coiler drum cleaner of claim 82, wherein the cooling means comprises passages in the cleaning element support member for circulating cooling liquid within the cooling element member.

85. The coiler drum cleaner of claim 84, wherein the cleaning element support member comprises longitudinally-extending rectangular tubes and the passages for circulating cooling liquid comprise the interiors of the tubes.

86. The coiler drum cleaner of claim 82, wherein the cooling means comprises a header for showering cooling liquid onto the cleaning element.

87. The coiler drum cleaner of claim 86, further comprising means for conducting cooling liquid showered on the cleaning element out of the coiler furnace.

88. The coiler drum cleaner of claim 87, wherein the means for conducting water out of the cleaning element support member comprises:

a) a drain hole proximate to the end of the cleaning element support member opposite the insertion end of the cleaning element support member; and b) a path, within the cleaning element support member, for water to flow from the cleaning end to the drain hole.

89. The coiler drum cleaner of claim 88, wherein the path is sloped to promote the flow of liquid to the drain hole.

90. The coiler drum cleaner of claim 82, wherein:

a) the cleaning element support member includes guide rails for guiding the movement of the carriage;

b) the carriage includes slide surfaces that abut the guide rails and slide along the guide rails during movement of the carriage; and c) the cooling means includes channels within the carriage running to cooling ports on the slide surfaces for providing a cooling liquid to the slide surfaces.

* * * * *

UNITED STATES PATENT AND TRADEMARK OFFICE

CERTIFICATE OF CORRECTION

PATENT NO. : 6,648,633 B1 
DATED : November 18, 2003
INVENTOR(S) : Suchan, Michael J., Brooks, Russell J. and Banowetz, Glen It is certified that error appears in the above-identified patent and that said Letters Patent is hereby corrected as shown below:

Column 19,
Line 64, “radial” should read -- radially --.

Column 20,
Line 42, “40” should read -- 46 --.

Column 23,
Lines 1 and 3, “axis” should read -- axial --.
Line 11, “74” should read -- 75 --.
Line 23, “78” should read -- 79 --.

Signed and Sealed this

Second Day of March, 2004

JON W. DUDAS
*Acting Director of the United States Patent and Trademark Office*